US011926405B1

(12) United States Patent
Boettcher et al.

(10) Patent No.: US 11,926,405 B1
(45) **Date of Patent: *Mar. 12, 2024**

(54) DRY STORAGE, RAW WATER SYSTEM FOR MARINE VEHICLES

(71) Applicant: SUMMIT MARINE TECHNOLOGIES, INC., South Abington Township, PA (US)

(72) Inventors: Mark A. Boettcher, South Abington Township, PA (US); Jeffrey Poole, Middletown, RI (US)

(73) Assignee: Summit Marine Technologies, Inc., South Abington Township, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/216,814

(22) Filed: Jun. 30, 2023

Related U.S. Application Data

(63) Continuation-in-part of application No. 18/095,557, filed on Jan. 11, 2023, now Pat. No. 11,731,751.

(51) Int. Cl.
*B63J 2/12* (2006.01)
*B63B 13/00* (2006.01)
(Continued)

(52) U.S. Cl.
CPC ..... *B63J 2/12* (2013.01); *B63B 79/10* (2020.01); *B63B 79/40* (2020.01); *B63J 2/00* (2013.01);
(Continued)

(58) Field of Classification Search
CPC . B63J 2/00; B63J 2002/005; B63J 2/02; B63J 2/04; B63J 2/12; B63B 79/10; B63B 79/40; B63B 2013/005
See application file for complete search history.

(56) References Cited

U.S. PATENT DOCUMENTS 3,012,757 A 12/1961 Marzolf
3,412,702 A 11/1968 Mann
(Continued)

FOREIGN PATENT DOCUMENTS

AU 2006200663 9/2007

OTHER PUBLICATIONS

Castle Pumps Ltd., Marine & Offshore Pump Solutions Catalog (2022).

(Continued)

*Primary Examiner* — Ajay Vasudeva
(74) *Attorney, Agent, or Firm* — Weitzman Law Offices, LLC

(57) ABSTRACT

A system for providing raw water for cooling of one or more Auxiliary Systems of a Luxury Boat, when the Luxury Boat is in Temporary Dry Storage involves a pump, external to the Luxury Boat, a controller coupled to the external pump and a sensor coupled to a boat-based pump controller on the Luxury Boat. The sensor is configured to sense a trigger signal from the boat-based pump controller indicating that raw water is to be pumped to the one or more Auxiliary Systems and send a signal to the controller that will cause the controller to start the external pump pumping raw water to the Luxury Boat. A related method for controlling raw water supply to one or more Auxiliary Systems of a Luxury Boat, when the Luxury Boat is in Temporary Dry Storage is also described.

18 Claims, 14 Drawing Sheets

(51) Int. Cl.

| | |
|---|---|
| ***B63B 79/10*** | (2020.01) |
| ***B63B 79/40*** | (2020.01) |
| ***B63J 2/00*** | (2006.01) |
| ***B63J 2/02*** | (2006.01) |

(52) U.S. Cl.
CPC ..... *B63J 2/02* (2013.01); *B63B 2013/005* (2013.01); *B63J 2002/005* (2013.01)

(56) References Cited

U.S. PATENT DOCUMENTS

| | | | | |
|---|---|---|---|---|
| 3,727,415 | A | 4/1973 | Williams | |
| 4,732,102 | A | 3/1988 | Holman et al. | |
| 4,763,592 | A | 8/1988 | Russ | |
| 5,445,101 | A | 8/1995 | Koch | |
| 5,549,069 | A | 8/1996 | Faidi | |
| 5,641,242 | A | 6/1997 | Riviere | |
| 6,227,133 | B1 | 5/2001 | Gross | |
| 6,830,002 | B1 | 12/2004 | Walker | |
| 7,096,809 | B1 | 8/2006 | Victor | |
| 7,207,746 | B1 | 4/2007 | Legun | |
| 7,421,963 | B1 | 9/2008 | Victor | |
| 7,444,952 | B1 | 11/2008 | McGann | |
| 9,885,499 | B2 | 2/2018 | Giampiccolo | |
| 10,065,709 | B2 | 9/2018 | Goves | |
| 10,913,526 | B2 | 2/2021 | Clark | |
| 11,052,984 | B1 * | 7/2021 | Boettcher | F24F 11/83 |
| 11,613,339 | B2 | 3/2023 | Lewis | |
| 11,731,751 | B1 * | 8/2023 | Boettcher | B63B 13/00 114/44 |
| 2002/0017108 | A1 * | 2/2002 | Schooley | B63J 2/04 62/240 |
| 2006/0180069 | A1 | 8/2006 | Stolzer | |
| 2008/0295758 | A1 | 12/2008 | Glessner et al. | |
| 2013/0291776 | A1 | 11/2013 | Howard | |
| 2016/0129983 | A1 * | 5/2016 | Giampiccolo | E02B 3/20 165/206 |
| 2021/0291944 | A1 | 9/2021 | Barber | |
| 2022/0340237 | A1 | 10/2022 | Chirakadze | |

OTHER PUBLICATIONS

Hammerhead/Barracuda Hybrid 6000/4590 GPH External Pump (Printed from https://www.bulkreefsupply.com/) (Jan. 2023).
Honda Self-Priming Submersible Trash Water Pump—9,000 GPH, 1 HP, 2in. Ports, Model# 611100 (Printed from https://www.northerntool.com/shop/tools/product_30846_30846) (Jan. 2023).
Isotherm 2513 Magnum Water Pump Cooled Refrigeration Component System (Printed from https://www.defender.com/) (Jan. 2023).
Isotherm Magnum ITC 4701 Water Cooled Refrigeration System w/ Holding Plate (Printed from https://www.defender.com/) (Jan. 2023).
Isotherm Plus ITC 4201 Holding Plate (Printed from https://www.defender.com/) (Jan. 2023).
Neptune Direct Drive 8-Post Yacht Lifts Brochure (2022).
Neptune G6 SuperFast 8-Post Yacht Lifts Brochure (2022).
Neptune G6 SuperFast® Direct Drive Beamless 4-Motor Lifts Brochure (2022).
Walrus PWA Series Submersible Pump Brochure (2022).
VANCS Submersible Seawater Pumps Catalog (2022).
offshoreonly.com postings (Oct. 1, 2006).
The QE2 Story Forum postings of Jan. 17, 24, 27-30, 2010 and Mar. 4, 2015 (Printed Nov. 2, 2022).
Datasheet "Wireless Control Relays With Two-Way Communication," Functional Devices, Inc. (pre-2021).
Datasheet for RIBU1C & RIBH1C—"10 AMP Pilot Control Relays, " Functional Devices, Inc. (Mar. 2023).
Datasheet for RIBMU1C—"15 AMP Track Mount Control Relay," Functional Devices, Inc. (Oct. 2019).
Datasheet for RIBMH1C—"15 AMP Track Mount Control Relay," Functional Devices, Inc. (Oct. 2019).

* cited by examiner

DRY STORAGE, RAW WATER SYSTEM FOR MARINE VEHICLES

CROSS REFERENCE TO RELATED APPLICATIONS

This application is a continuation-in-part of U.S. patent application Ser. No. 18/095,557 filed Jan. 11, 2023, the entirety of which is incorporated herein by reference.

FIELD OF THE INVENTION

This disclosure relates generally to boats and, more particularly, to temporarily dry stored boats.

BACKGROUND

Boat lifts provide many advantages for marine vehicle (i.e., boat) owners. Since they keep the entire boat out of the water, they reduce fouling of the hull and the need for hull maintenance, help minimize corrosion and electrolysis, make routine maintenance easier, reduce the risk of damage during inclement weather due to contact with other boats or the dock/slip, and help minimize the risk of theft.

Boat lifts are commonly used for temporary dry storage of boats, e.g., weekend boaters may use them to keep their boat out of the water during the work week while having the boat readily available for the weekend. Given their advantages, many boat owners will use their boat lift at the end of a day of boating, for overnight dry storage, even if they will be using the boat the very next day.

However for boats with cabins, being in temporary dry storage does not remove the boat from an inherently humid environment, since the boat is merely raised above the water surface. As a result, the cabins are susceptible to mold and mildew growth problems and, in warm locations, the combination of heat and humidity can cause other damage to, for example. wood trim and other cabin components and furniture, such as through warping, de-lamination, peeling of paint, etc.

Moreover, in dry storage, raw water cooled auxiliary systems, such as chiller plates, ice makers, refrigerators and freezers cannot be run, so boat owners must remove perishables, particularly food items, from their boats, even if they intend to use the boat the next day.

Attempts have been made by boat owners to address the humidity issue by placing home-type dehumidifiers in the cabin, but that approach is annoying and often barely satisfactory. And it doesn't address any of the other problems.

A recent patent publication, US20220340237 has suggested that the boat's fresh water supply can be used to supply water that would be used by the boat's raw water cooled devices, such as air conditioning, when the boat is in dry dock. However, even many very large boats of 15 meters (50 feet) or more, have less than 1,140 liters (approx. 300 gallons) of stored fresh water on board when full, and the air conditioners in such vehicles often require flow rates of 1,900 liters per hour (500 gallons per hour) or more for cooling. Still further, such usage of the fresh water would deplete that water supply as it cannot be returned for the same use. Thus, despite the suggestion of that publication, it is not possible to operate the air conditioning as suggested. Still further, the use of externally supplied fresh water, for example from the home, would be exceedingly costly and, some manufacturers of raw water cooled marine air conditioners for use in salt water environments specifically advise against using fresh water for cooling.

A similar problem exists for boats that contain live wells that are used to store live bait or caught fish. Such live wells similarly also often require in excess of 950 liters per hour (250 gallons per hour). Thus, for such dry stored boats that contain live wells, the live well cannot be used when the boat is in dry storage.

Another problem exists when it comes to winterizing boats having raw water cooled auxiliary systems. Winterizing is necessary prevent damage to those systems when the boat is in dry storage and subjected to temperatures below freezing for a protracted period of time (e.g., days or more). One approach to doing so is to drain all water from the entirety of such systems. However, it is extremely difficult to get all of the water out. As a result, if that water freezes, damage can result, either from the sharpness of the ice crystals that form, or due to the expansion from freezing causing a rupture where the water is located.

An alternative is to try and fill the systems with an appropriate mixture of antifreeze. Unfortunately, it is difficult, time consuming, and costly to reliably fill such systems with a antifreeze, particularly, with larger boats and/or with boats having more than one such auxiliary system.

Thus, satisfactory solutions for the aforementioned problem(s), individually and collectively, remain elusive.

SUMMARY

This disclosure describes solutions that provide significant advances in addressing the aforementioned problems.

One aspect of this disclosure involves a system for providing raw water for cooling of one or more Auxiliary Systems of a Luxury Boat, when the Luxury Boat is in Temporary Dry Storage. The system involves a pump, external to the Luxury Boat, having an associated raw water inlet and a raw water outlet, a hose having a first end being coupled to the raw water outlet and a second end configured to matingly couple to a connector on the Luxury Boat that is coupled to at least one Auxiliary System of the Luxury Boat; a controller coupled to the external pump; and a sensor coupled to a boat-based pump controller on the Luxury Boat. The boat-based pump controller controls pumping of raw water to the at least one Auxiliary System on the Luxury Boat. The sensor is configured to sense a trigger signal from the boat-based pump controller indicating that raw water is to be pumped to the at least one Auxiliary System and send a signal to the controller that will cause the controller to start the external pump pumping raw water to the Luxury Boat via the hose.

Another aspect of this disclosure involves a system for use with a Dry Storage Lift capable of moving Luxury Boats between an in-water position and a dry storage position. The system involves an external pump having an associated raw water inlet and a raw water outlet. The raw water outlet is configured to matingly couple, via a connector, to a corresponding connector on a through-hull fitting of a Luxury Boat. The system further involves a sensor associated with a boat-based pump controller; and a controller, communicatively coupled to the sensor, such that when the boat-based pump controller sends a signal for raw water to be sent to at least one Auxiliary System of the Luxury Boat, the sensor will sense the signal and send a pump signal to the controller so that the controller will cause the external pump to deliver raw water to the Luxury Boat, for use by the at least one Auxiliary System, via the raw water outlet.

Yet another aspect of this disclosure involves a method for controlling raw water supply to one or more Auxiliary Systems of a Luxury Boat, when the Luxury Boat is in Temporary Dry Storage. The method involves sensing a trigger signal sent by a boat-based pump controller indicating that raw water is to either be supplied to the one or more Auxiliary Systems of the Luxury Boat or stop being supplied to the one or more Auxiliary Systems of the Luxury Boat. The method further involves, based upon the sensing, sending a signal to a controller of an external pump coupled to the Luxury Boat such that: (A) if the sensed trigger signal indicates that raw water is to be supplied to the one or more Auxiliary Systems of the Luxury Boat, the signal will cause the controller to turn on an external pump coupled to the controller, and (B) if the sensed trigger signal indicates that raw water is to stop being supplied to the one or more Auxiliary Systems of the Luxury Boat, the signal will cause the controller to turn off the external pump.

BRIEF DESCRIPTION OF THE DRAWINGS

This disclosure is further described in the detailed description that follows, with reference to the drawings, wherein the same reference numbers appearing in the various drawings and description designate corresponding or like elements among the different views. and in which.

DETAILED DESCRIPTION

As an initial matter, for purposes of brevity, the following definitions are intended to apply wherever the identified term is used.

The term "Auxiliary System" means a raw water using device on a marine vehicle, other than its engine(s), for example, devices cooled using raw water such as an air conditioner, a climate control system (that can supply heating and/or cooling), an ice maker, a refrigerator, a freezer, a live well (a.k.a. a fish box), a cold plate (a.k.a. a chiller plate or holding plate), a gyro stabilizer, or a generator that can run independent of the Luxury Boat engine(s), and other well as other raw-water-using systems, for example, a raw water washdown system.

The term "Luxury Boat" means a boat having a wet weight within the rounded range of between about 1,360 Kg and about 36,250 Kg (about 3,000 lbs and about 80,000 lbs) and includes at least one Auxiliary System installed thereon. Note here that, as a general matter, the term "about" is used in connection with wet weight because it can readily vary for the same Luxury Boat based upon the specific amount of fuel on board, as well as the specific equipment, furnishings, etc. Nevertheless, the exact wet weight of any given Luxury Boat is not critical and only intended to provide a sense of the range of Luxury Boats to which the systems as described herein are applicable.

The term "Dry Storage Lift" means any type of device that is constructed to temporarily raise and lower a Luxury Boat so that the hull goes between states where (i) the hull is in the water, and (ii) the hull is not in the water. Representative examples of a Dry Storage Lift as defined herein include, but are not limited to, the following: a cradle lift. a silhouette lift, an elevator lift, a boathouse lift, a beamless lift, a yacht lift, and seawall mounted davits, a floating dry dock, as well as devices such as shown, described, or similar to, those illustrated, described and/or claimed in U.S. Pat. Nos. 3,012,757, 3,412,702, 3,727,415, 4,732,102, 5,549,069, 5,641,242, 6,830,002, 7,096,809, 7,421,963, 10,065,709, U.S. Pat. Pub. No. 20060180069, U.S. Pat. Pub. No. 20130291776, U.S. Pat. Pub. No. 20210291944, and AU Pat. No. 2006200663. All of the foregoing U.S. Patents and Published U.S. patent Applications are incorporated herein by reference in their entirety. For clarity, a Dry Storage Lift as defined does not include any form of boat trailer designed to be towed by a vehicle or a moving gantry.

The term "Temporary Dry Storage" means the state where a Luxury Boat is on a Dry Storage Lift to a position such that a scoop strainer of the Luxury Boat is not submerged in a source of raw water.

With the foregoing definitions in mind, various configurations will now be described.

Figure 1:
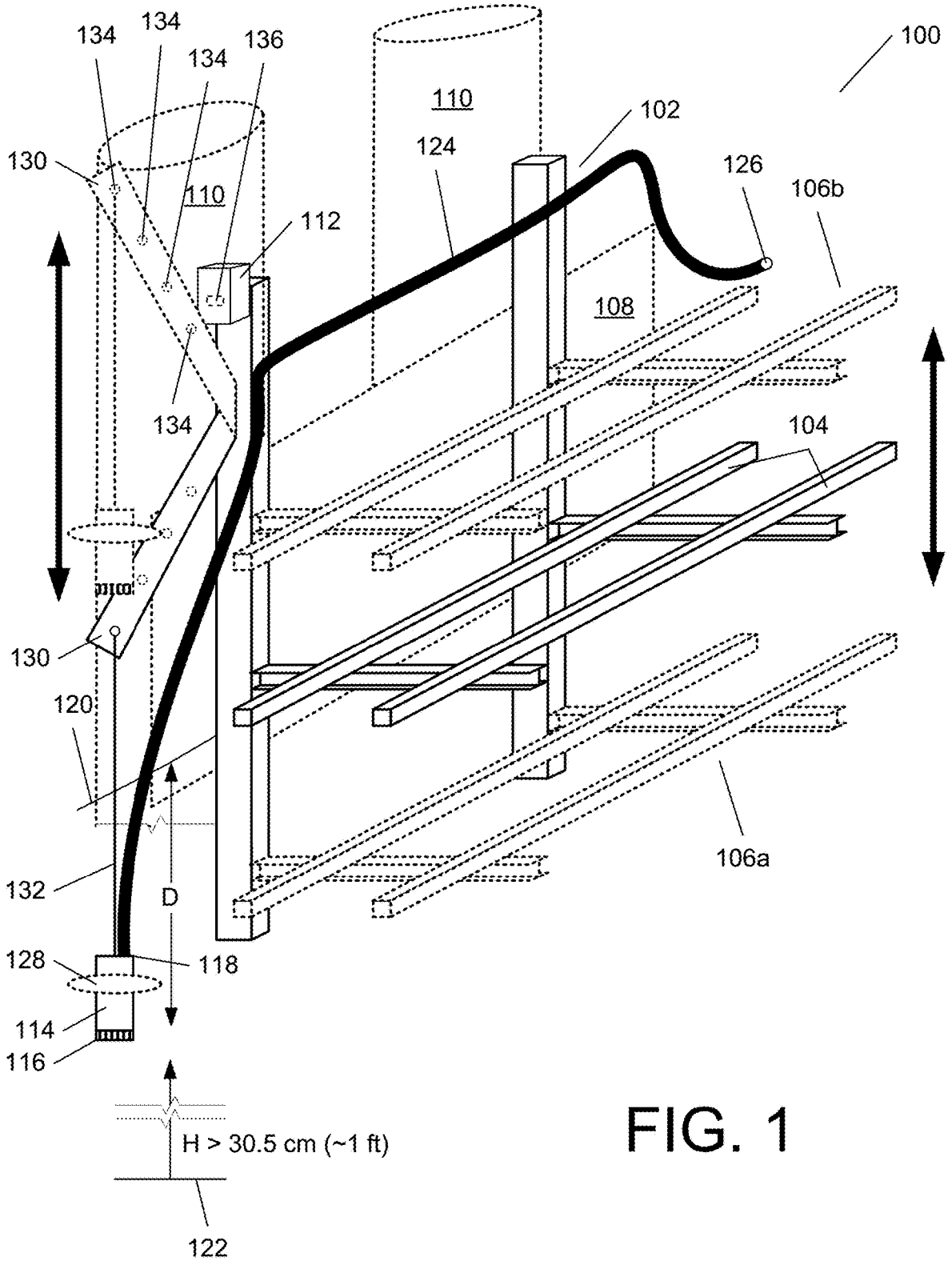
FIG. 1 illustrates, in simplified form, a first example variant system according to the teachings herein.

FIG. 1 illustrates, in simplified form, a first example variant system 100 according to the teachings herein.

This variant system 100 includes an elevator type Dry Storage Lift 102 for a Luxury Boat, having bunks 104 (positioned to engage a Luxury Boat's hull via bunk covers (not shown)) that are moveable, within a range, between a position 106*a* that will have the Luxury Boat in the water and another position 106*b* that will have the Luxury Boat fully out of the water.

Depending upon the particular Dry Storage Lift 102, the Dry Storage Lift 102 may be free standing, it may be coupled to a surface 108 of a seawall, dock or bulkhead, or it may be coupled to one or more pilings 110. The Dry Storage Lift includes a an associated controller 112, which may be programmable or a non-programmable switch or relay, that controls the movement and position of the bunks 104 and/or other components that are involved in controlling operation of a pump 114 as described below.

The variant system 100 further includes the pump 114, as shown, a submersible pump, having a raw water inlet 116 and a raw water outlet 118. Under control of the controller 112, the pump 114 is movable between a position where it is in a source of raw water at a depth "D" that below a minimum or low raw water surface level 120 at the location (e.g., based upon tides, seiches, rainwater/runoff, etc.) and also at a height "H" above the floor 122 of the raw water source, ideally at least 30.5 cm (approximately 1 ft.), so as to minimize clogging of the raw water inlet 116 by floating debris or vegetation, algae, sunken matter on, at, or near, the floor 122. A hose 124 is coupled, at one end, to the raw water outlet 118 and the other end includes a connector 126 that is of a type that will matingly connect to a a corresponding connector (not shown) on a Luxury Boat. Depending upon the particular implementation, the connector 126 can be a screw-type connector, a bayonet-type connector, any appropriate quick connect/disconnect connector, or any other type of connector, the important aspect being the connection of the hose 124 to the Luxury Boat so that raw water pumped by the pump 114 can be delivered to the Luxury Boat via the hose 124 and coupled connector 126, not the type of connector 126 used.

Optionally, the pump 114 may include or have coupled to it, a float 128 that will assist in offsetting the weight of the pump 114, making it more buoyant, and thereby help maintain the pump 114 at the desired depth.

As shown, this variant system 100 further includes an arm 130, to which the pump 114 is coupled. The arm 130 is moveable such that when the Dry Storage Lift 102 is in the lowered position (i.e., so a boat on it would be in the raw water source), the pump 114 will be out of the raw water source and when the Dry Storage Lift 102 is in the raised position (i.e., so a boat on it would be out of the raw water source), the pump 114 will be in the raw water source.

As shown, the pump 114 is coupled to the arm 130 via an extension 132, which may be a rod, chain, cable, rope, etc., whose length can fully or partially establish the depth D the pump 114 will be at when submerged. Optionally, to, in whole or part, assist in setting the depth of the pump 114, the arm 130 may include one or more attachment locations 134 (e.g., holes, slots, grooves, etc.) to which the end of the extension opposite the pump may be connected. Advantageously, such an option allows for minor adjustments according to, for example, seasonal changes in raw water source depth, a change in Luxury Boat, or other changed circumstances.

Finally, optionally, the controller 112 may include additional circuitry 136, for example, a processor and/or wired or wireless communications circuitry, to, for example, allow for adjustment of the operation of the Dry Storage Lift 102 and/or pump 114 remotely, by a person (locally or remotely) or another controller, for example, a boat-based pump controller on the Luxury Boat.

Figure 2:
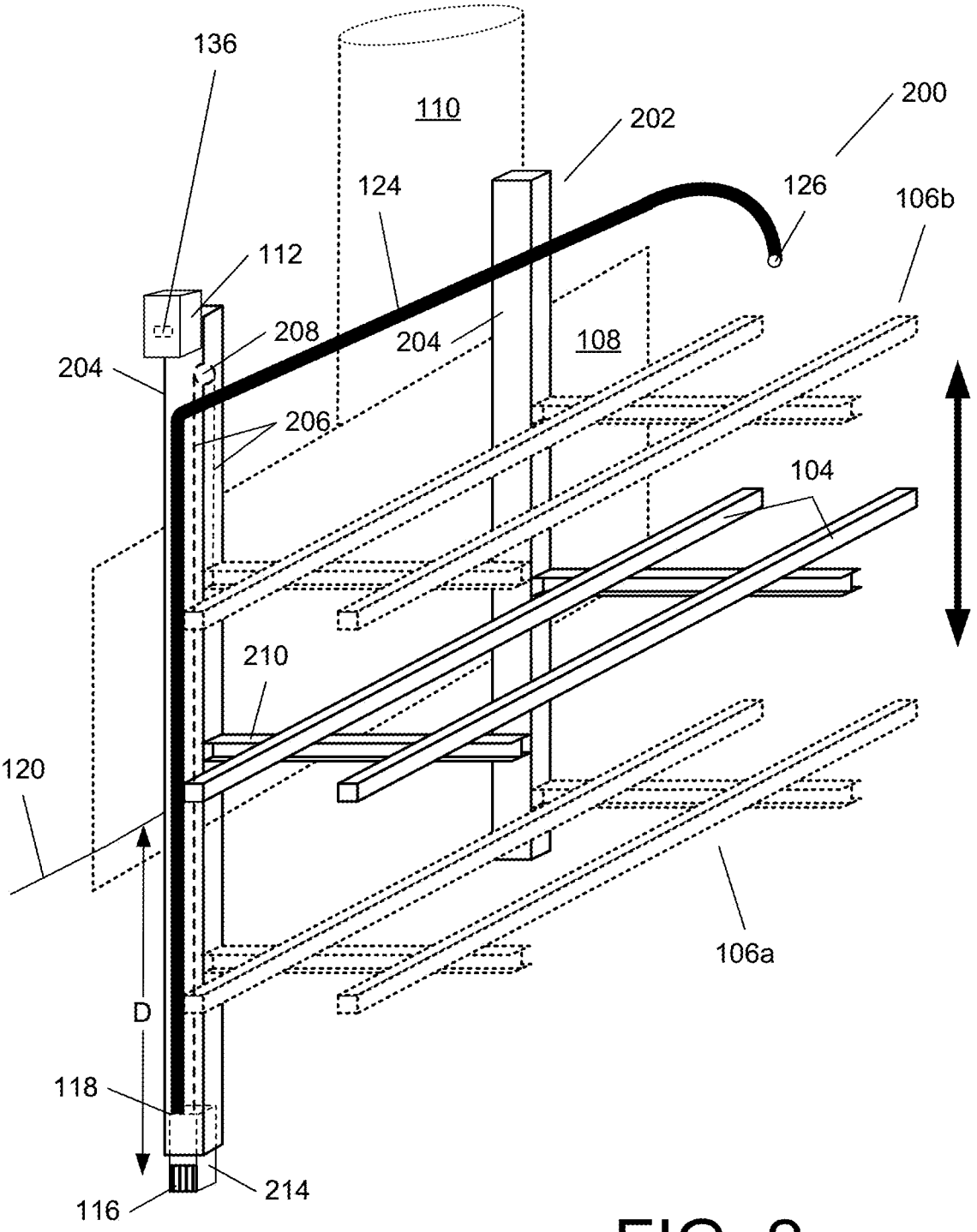
FIG. 2 illustrates, in simplified form, an alternative example variant system according to the teachings herein.

FIG. 2 illustrates, in simplified form, an alternative example variant system 200 according to the teachings herein.

As shown, this variant system 200 is similar to that of FIG. 1 except that the Dry Storage Lift 202 of FIG. 2, includes a submersible pump 214 that moves up and down within a post 204 of the Dry Storage Lift 202. In this variant system 200, the movement of the pump is accomplished using a simple cable or chain 206 that is coupled at one end to the pump 214 and loops over a wheel 208 and is attached at its other end to a support bar 210 for the bunks 104. As a result, the mere act of raising or lowering the bunks 104 of the Dry Storage Lift 202 will have the opposite effect on the pump (i.e., as one goes up, the other goes down).

As shown, with this variant, when the Dry Storage Lift 202 is fully raised, at east the raw water inlet 116 will be located outside of a post 204 of the Dry Storage Lift. Of course, with other variants, this need not be the case. For example, the raw water inlet 116 could remain inside the post 204 provided there are some way that it will be submerged within the raw water source (e.g., due to one or more opening(s) in the post), or the entire pump 214 could be lowered so as to be outside the post 204.

Figure 3A:
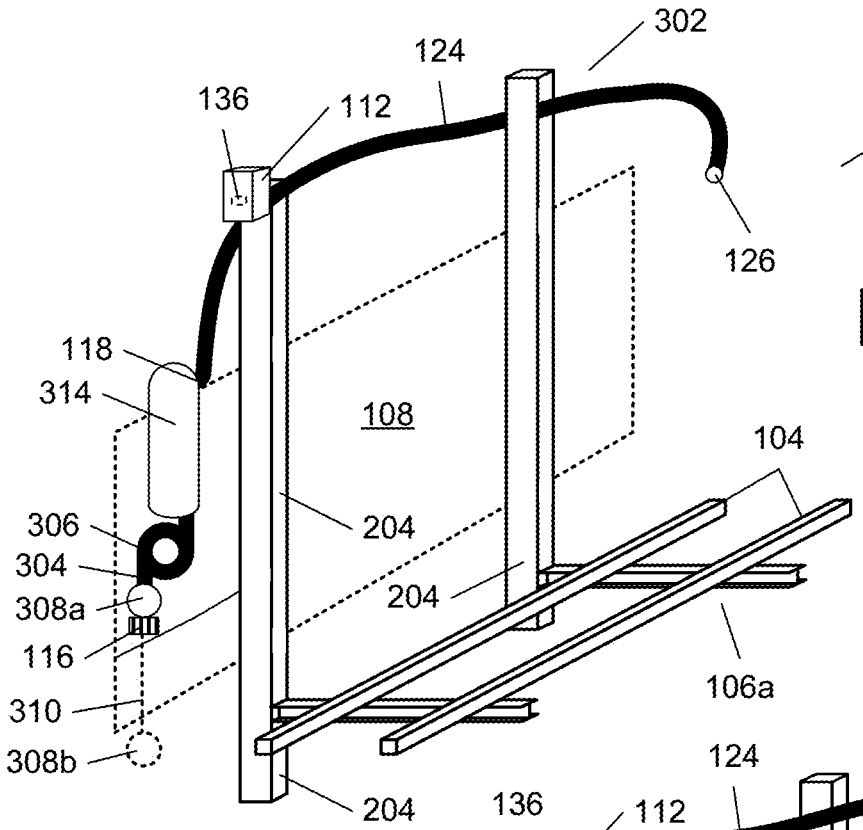
FIGS. 3A-3B illustrate, in simplified form, another alternative example variant system according to the teachings herein.
Figure 3B:
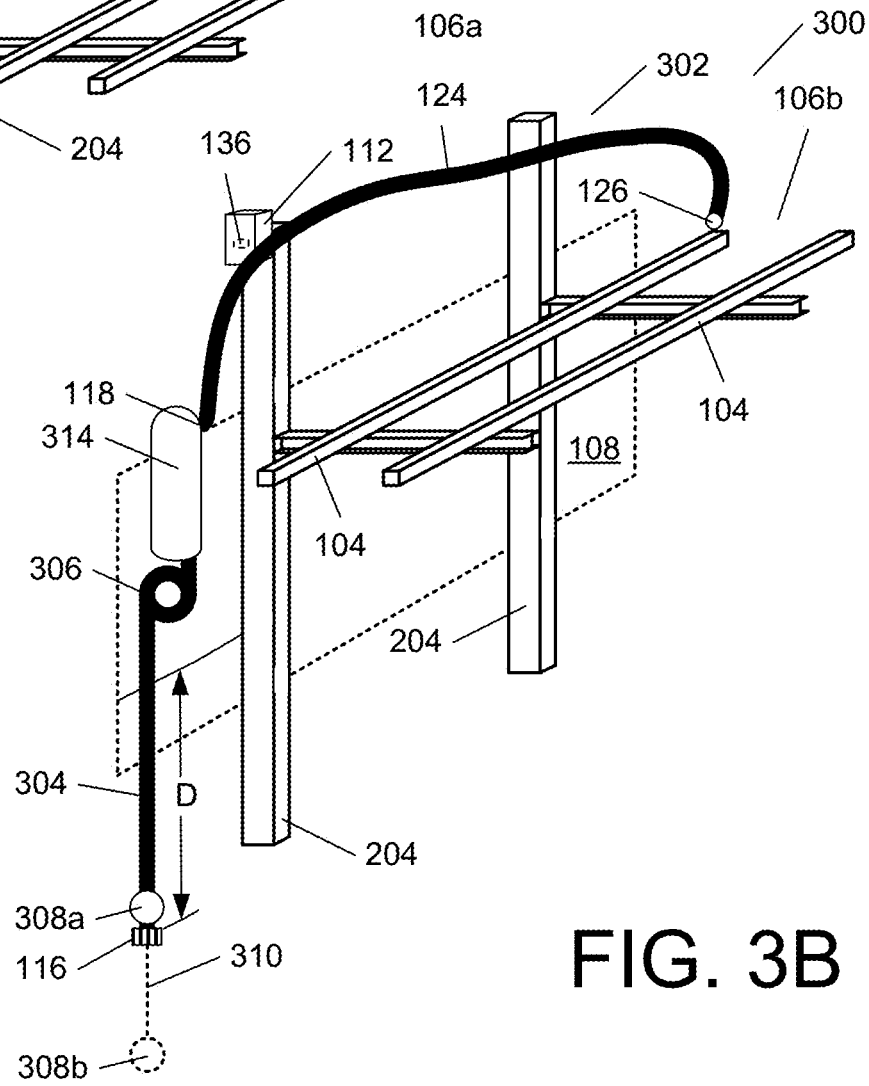

FIGS. 3A-3B illustrate, in simplified form, another alternative example variant system 300 according to the teachings herein.

As shown in FIGS. 3A-3B, this variant system 300 includes at least one post of the Dry Storage Lift 302 mounted to a surface 108 of a seawall, dock or bulkhead. This variant system 300 also includes a non-submersible pump 314 that is likewise mounted on the surface 108 of a seawall, dock or bulkhead above the highest expected raw water level. As with the prior variants of FIGS. 1-2, the pump 314 has a raw water outlet 118 connected to a hose 124 that is usable to supply raw water to a Luxury Boat (not shown) via the connector 126. The pump 314 has a raw water inlet 116 that is coupled to the pump 314 via a hose 304 that is wound about a spool 306. As a result, as shown in FIG. 3A, when the Dry Storage Lift 302 is in the lowered position 106*a* where the bunks 104 are in the water, the hose 304 will be retracted about the spool 306 such that the raw water inlet is above the high water level of the raw water source. In contrast, as shown in FIG. 3B, when the Dry Storage Lift 302 is in the raised position 106*b* where the bunks 104 are out of the water, the hose 304 will be unwound from the spool 306 to lower the raw water inlet 116 into the water. Depending upon the buoyancy of the hose and raw water inlet (which may, and typically would, include a strainer) optionally an additional weight 308*a* may be coupled to the raw water inlet 116 (for example, above it on the hose 304 or an additional weight(s) 308*b* can be coupled to or suspended below the raw water inlet 116. Advantageously, in the latter case, a line, wire or chain 310 can be used such that, when the raw water inlet 116 is in the raw water source, the weight(s) 308*b* can rest on the bottom of the raw water source and act as a form of anchor to prevent the raw water inlet 116 from excessive movement due to movement of water within the raw water source.

In such a configuration, the pump 314 should ideally be self priming and be sized so as to have a sufficient total head (i.e., suction head plus discharge head) and pump lift to be able to deliver raw water to the Luxury Boat. Moreover, irrespective of whether the pump is submersible or not, it should ideally be capable of delivering raw water to the connector 126 at a rate based upon the maximum raw water required if the specific Auxiliary System(s) of the Luxury Boat would be operated concurrently, which could range anywhere from a fixed rate of about 900 liters/hour (about 4 gallons/minute) to about 7,000 liters/hour (about 33 gallons/minute). In most cases, the pump should be capable of delivering raw water at a fixed rate of at least 1,900 liters/hour (about 8.4 gallons/minute). With respect to the raw water delivery rate, the term "about" (not used in connection with metric to English conversion) is used because there could be nominal variation due to particulates in the pumped raw water, common build-up of material within the hose over time, the specific length of the hose used, etc., and to take into account such normal variance.

Figure 4A:
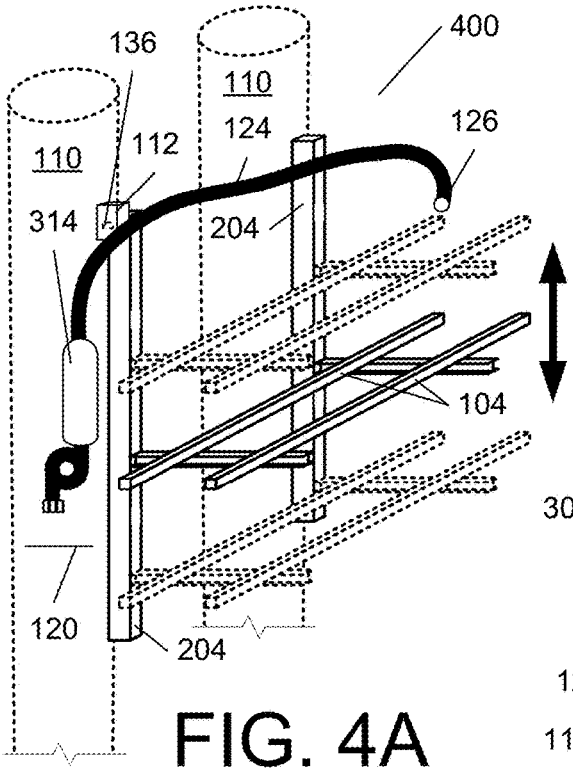
FIGS. 4A-4B illustrate, in simplified form, another alternative example variant system according to the teachings herein.
Figure 4B:
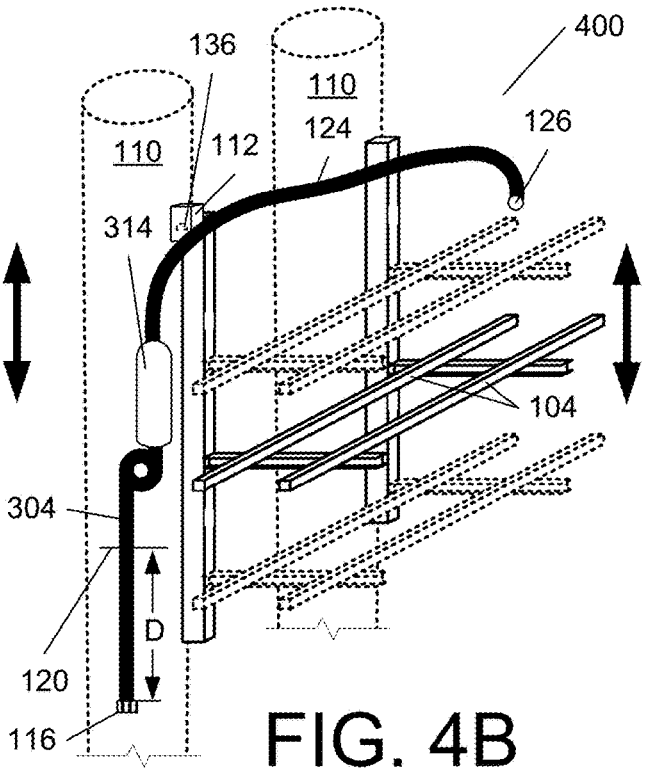

FIGS. 4A-4B illustrate, in simplified form, another alternative example variant system 400 according to the teachings herein that is identical to the variant system 300 of FIGS. 3A-3B except that this variant system is mounted on two or more pilings 110 and the pump 314 is mounted on one of those pilings 110.

Figure 5:
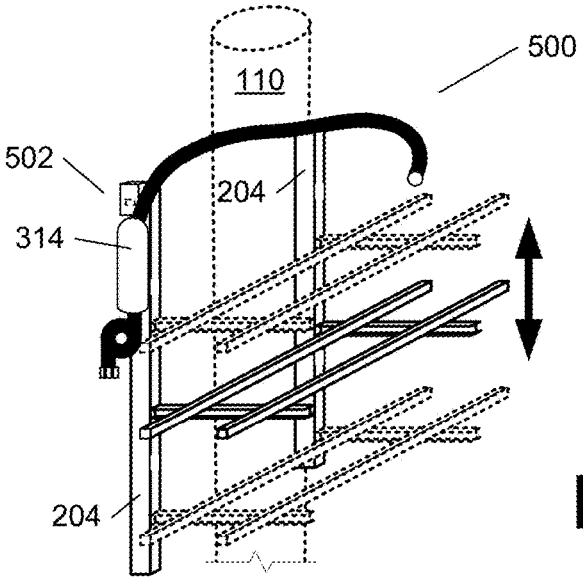
FIG. 5 illustrates, in simplified form, yet another alternative example variant system according to the teachings herein.

FIG. 5 illustrates, in simplified form, yet another alternative example variant system 500 according to the teachings herein that is identical to the variant system of FIGS. 4A-4B except that the Dry Storage lift 502 of this variant 500 is mounted to a single piling 110 and the pump 314 is mounted on one post 204 of the Dry Storage Lift 502.

Having described multiple example variant systems in connection with FIGS. 1, 2, 3A-3B, 4A-4B and 5, it should now be apparent from the foregoing that multiple other variants can be created that employ the same principles to enable the delivery of raw water to the Auxiliary System(s) of a Luxury Boat when out of the water on a Dry Storage Lift.

Based upon the foregoing, some examples of the boat-based aspects relating to the systems described herein will now be described.

Figure 6:
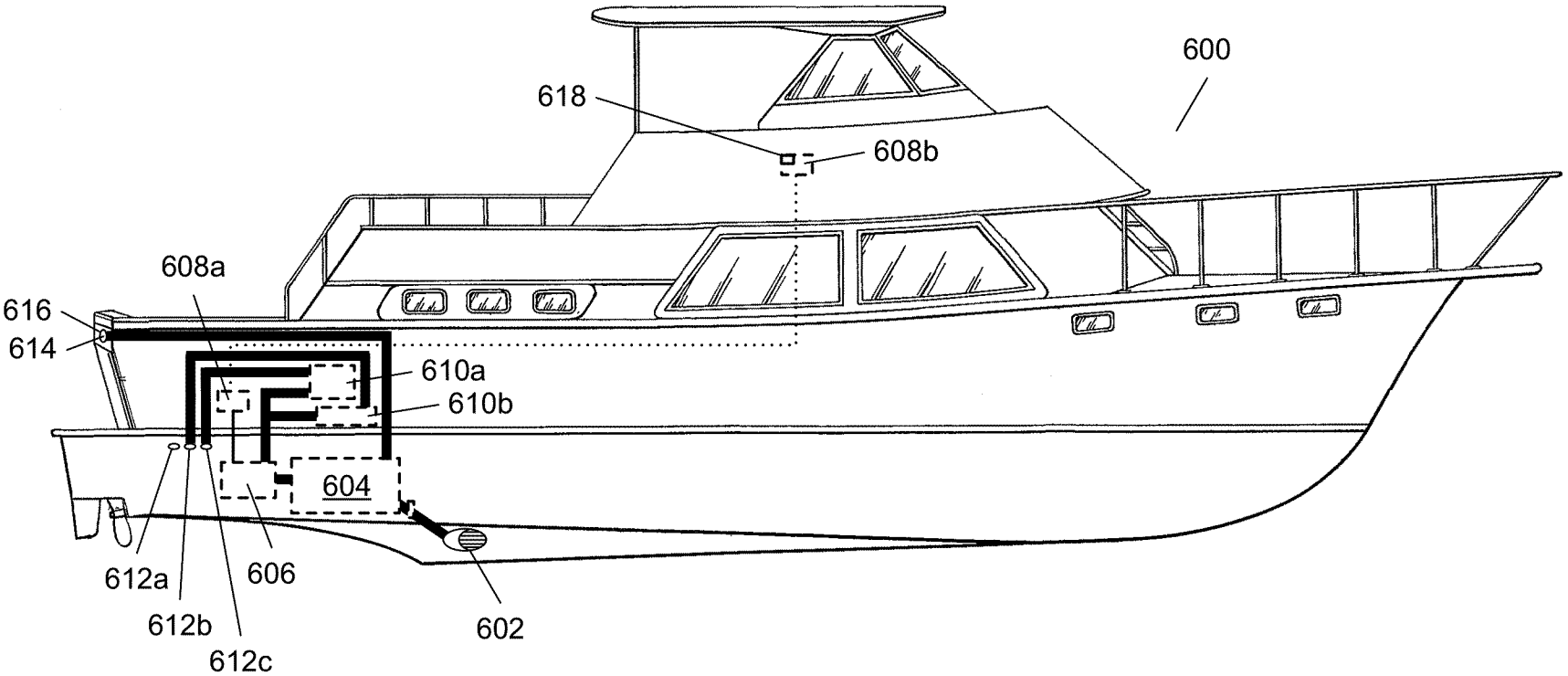
FIG. 6 illustrates, in simplified form, a side view of an example Luxury Boat having a wet weight of about 36,250 Kg (about 80,000 lbs)

FIG. 6 illustrates, in simplified form, a side view of an example Luxury Boat 600 having a wet weight of about 36,250 Kg (about 80,000 lbs), which is at the top of the range for which a Dry Storage Lift including a variant like one of the systems described herein would likely be used.

As shown, the Luxury Boat 600 includes a scoop strainer 602 located below the water line and close to the keel so that, when the boat is in the water, even if at maximum speed or "on plane" the scoop strainer 602 will be in the water so that raw water can be channeled through it into the Luxury Boat 600. In this particular Luxury Boat 600, in normal operation, raw water entering the scoop strainer 602 is channeled, typically via a sea cock (not shown), into a sea chest or manifold 604 which holds some volume of raw water. That raw water is pumped by a boat-based pump 606, operating under control of a boat-based pump controller 608*a*, 608*b*, which, depending upon the particular Luxury Boat may be entirely automatic or allow for manual control (e.g., a programmed or programmable module, a logic circuit, one or more relay(s) or switch(es), etc.), to control supplying of raw water to cool one or more Auxiliary Systems 610*a*, 610*b*—the important aspect being the control, not the device used to provide it. In some implementations, a portion of the boat-based controller 608*b* may include a sensor 618 that will sense a signal from a controller of a system as described herein and, for example, act as an interface between the controller of the system and the boat based controller and may include a port to which a wired connection can be made or a wireless transmitter, receiver or transceiver, depending upon the particular implementation. The control process for obtaining and directing the raw water, in operation, may, of course, involve one or more additional valves (for example, pneumatically actuated, electrically actuated, manually actuated, etc.) (not shown) located between the boat-based pump 606 and the Auxiliary Systems 610*a*, 610*b*. Once the cooling raw water has passed through the one or more Auxiliary Systems 610*a*, 610*b*, it exits the Luxury Boat 600 via one or more raw water discharge ports 612*a*, 612*b*, 612*c*.

When the Luxury Boat 600 is on a Dry Storage Lift, as described herein, the scoop strainer 602 will be out of the water and, thus, unable to supply raw water for cooling of any Auxiliary Systems of the Luxury Boat. Accordingly, to use a system as described herein, an auxiliary raw water inlet 614, located above the water line, is provided that has an external connector 616 configured to correspondingly mate with a connector 126 of a system as described herein. Depending upon the particular Luxury Boat and/or Dry Storage Lift and system, the auxiliary raw water inlet 614 and external connector 616 can be incorporated by the boat manufacturer, or it can be added "aftermarket" by, for example, the provider of the Dry Storage Lift, the provider of an associated system as described herein, or by a third party.

The raw water inlet 614 is coupled to the sea chest or manifold 604 so that raw water can be fed by a system as described herein to the sea chest or manifold 604 for supply to the one or more Auxiliary Systems 610*a*, 610*b* by the boat-based pump 606. As will of course be understood, all of these components will be interconnected as appropriate via piping or hoses.

Figure 7A:
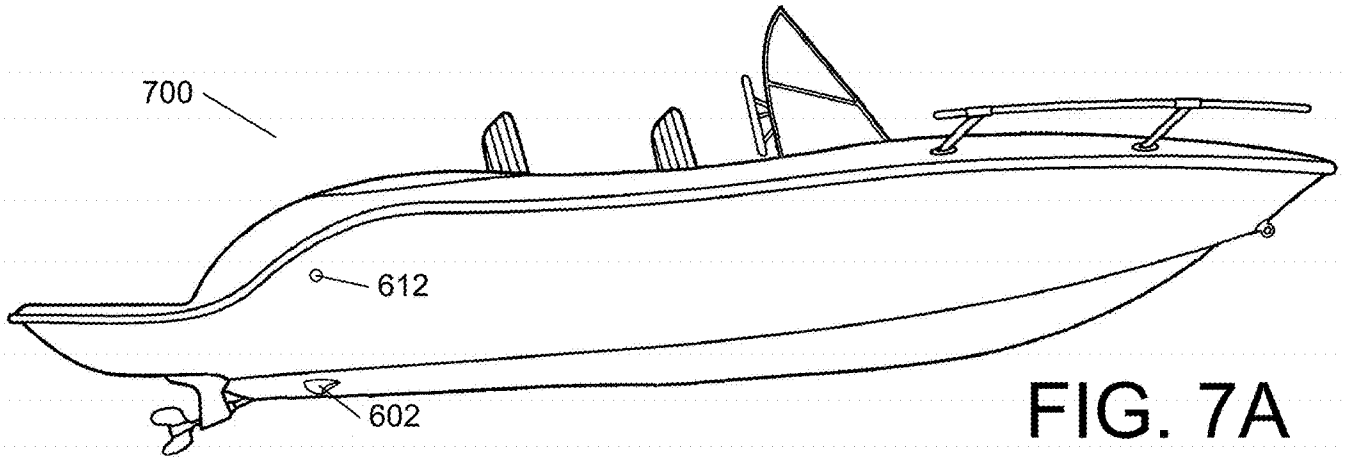
FIGS. 7A-7B illustrate, in simplified form, an example of a Luxury Boat having a wet weight of about 1,360 Kg (about 3,000 lbs)
Figure 7B:
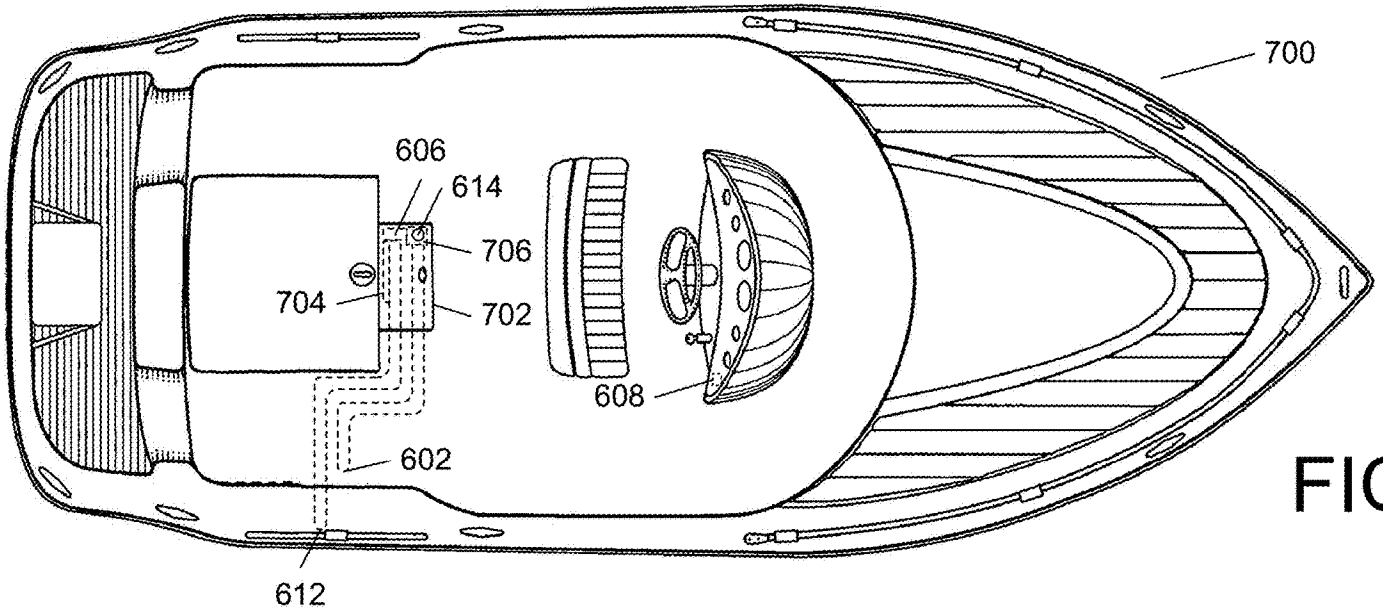

FIGS. 7A-7B illustrate, in simplified form, an example of a Luxury Boat 700 having a wet weight of about 1,360 Kg (about 3,000 lbs), which is at the bottom of the range for which a Dry Storage Lift including a variant like one of the systems described herein would likely be used. As shown, the dashed lines indicate components within the hull of the Luxury Boat 700.

More particularly, FIG. 7A is a side view of the Luxury Boat 700 so that the scoop strainer 602 and raw water discharge port 612 are visible and FIG. 7B is a top view of the Luxury Boat 700 of FIG. 7A.

As can be seen in FIG. 7B, this Luxury Boat 700 includes a single Auxiliary System in the form of a live well or bait freezer 702 that includes one or more water cooled chill plate(s) 704. As shown, in normal operation, raw water is fed from the scoop strainer 602 to a manifold 706 where a boat-based pump 606 (under control of a boat-based controller 608) pumps it to the chill plate(s) 704. Thereafter, the raw water exits the boat via the discharge port 612.

When the Luxury Boat 700 is on a Dry Storage Lift and needs to keep the live well or bait freezer 702 operating (i.e., raw water needs to be fed to the chill plate(s) 704, the connector 126 of a system as described herein will be connected to the raw water inlet 614 to supply raw water into the manifold 706 for use by the pump 606.

Figure 8:
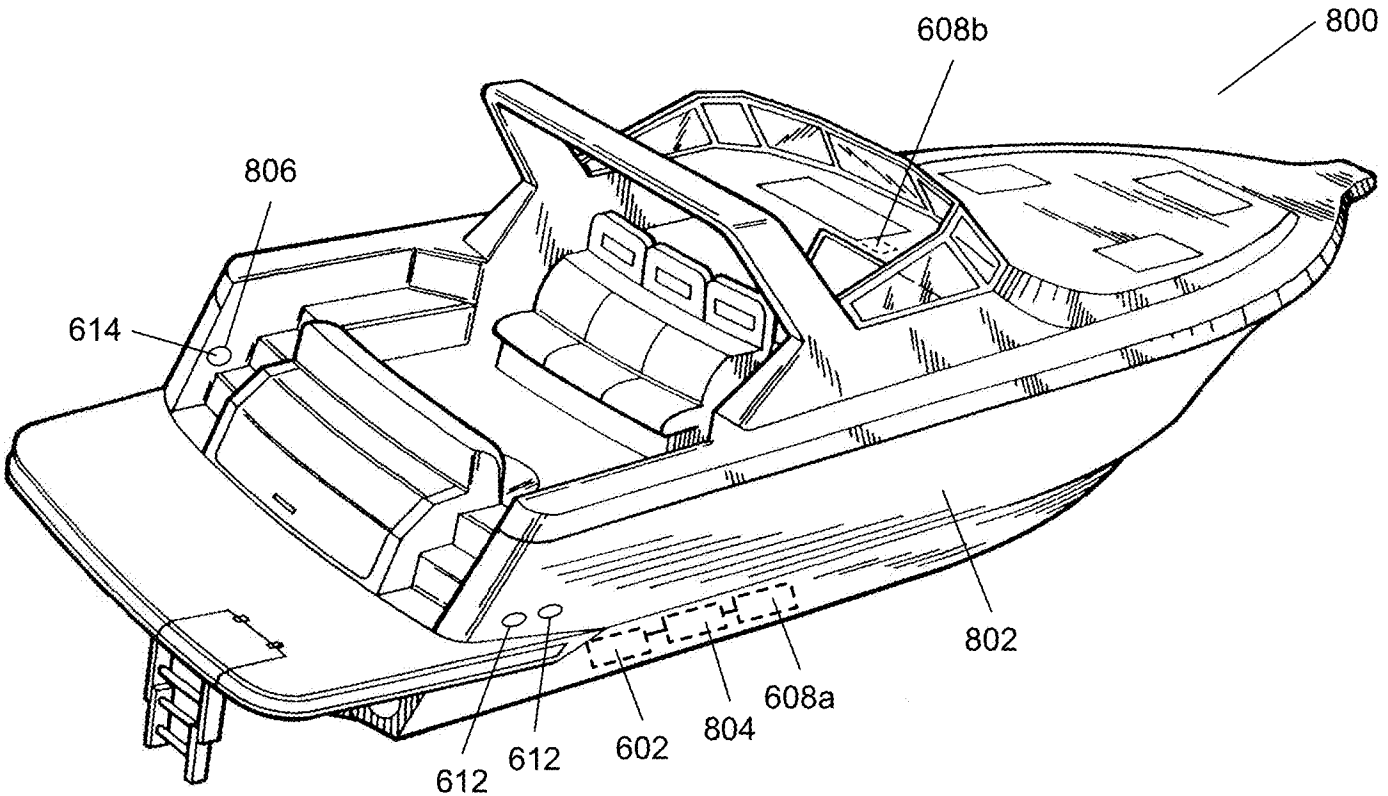
FIG. 8 illustrates, in simplified perspective view, another example Luxury Boat having a wet weight of about 11, 350 Kg (about 25,000 lbs)

FIG. 8 illustrates, in simplified perspective view, another example Luxury Boat 800 having a wet weight of about 11,350 Kg (about 25,000 lbs), which is a common wet weight within the range for which a Dry Storage Lift including a variant like one of the systems described herein would likely be used.

As shown, in FIG. 8, this Luxury Boat includes a scoop strainer 602 and a sea chest 804 within the hull 802. This Luxury Boat also includes at least two Auxiliary Systems (not shown) that are fed cooling raw water by a pump (not shown), operating under control of a boat-based controller 608, from raw water in the Sea chest 804. An auxiliary raw water inlet 614 is locate on the port side aft under a cover 806 that covers the connector 616 to which a system connector 126 would matingly connect.

With ongoing reference to the Luxury Boat 800 of FIG. 8, the operation of an example system according to the teachings herein will now be described.

Figure 9A:
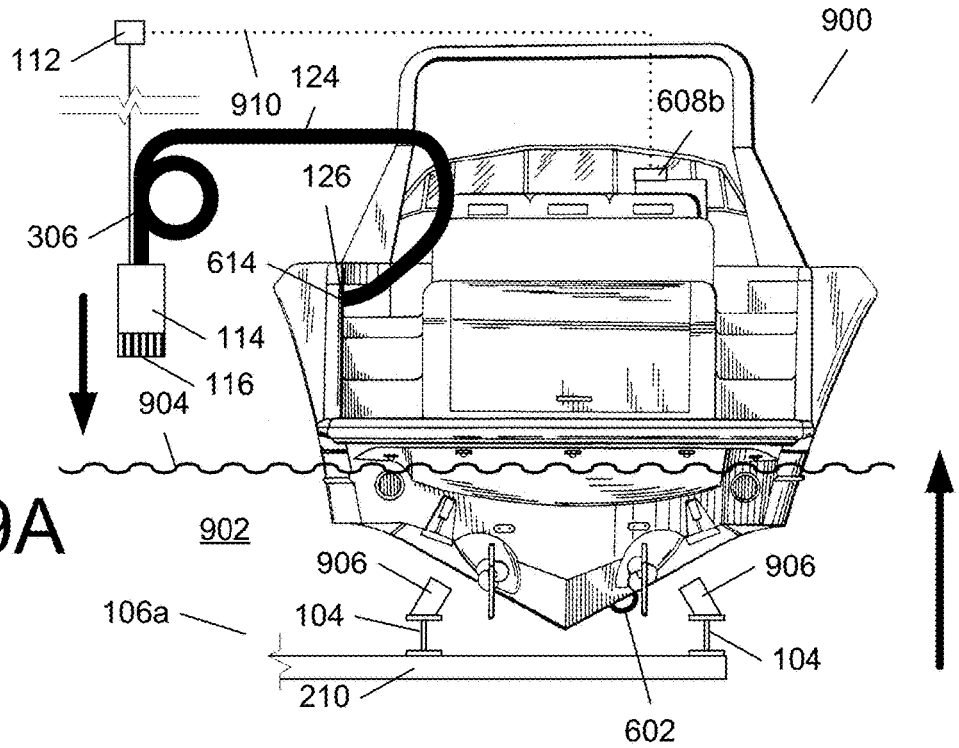
FIG. 9A illustrates, in simplified form, a rear view of the Luxury Boat of FIG. 8 along with portions of various components of an example variant system constructed according to the teachings herein.

FIG. 9A illustrates, in simplified form, a rear view of the Luxury Boat 800 of FIG. 8 along with portions of various components of an example variant system 900 constructed according to the teachings herein, but only a portion of which are shown, in conjunction with a portion of an example Dry Storage Lift, only a portion of which is also shown, when the Luxury Boat 800 is floating in a raw water source.

In FIG. 9A, the Luxury Boat 900 is floating in the raw water source 902 so that the scoop strainer 602 is submerged well below the surface 904 of the raw water source. As further shown, the Luxury Boat is positioned over the boat-cradling bunks 104, which are fitted with bunk covers 906 that actually would engage the hull of the Luxury Boat and prevent damage/marring of the hull or gelcoat paint thereon.

With further reference to FIG. 9A, this figure shows an example state where the Luxury Boat is ready to be dry stored for some relatively short period of time. Thus, since the Dry Storage Lift is in the lowered position 106*a*, the pump 114 for the system is retracted out of the raw water source 902, but the hose 124 for the system has been coupled to the Luxury Boat 800 via the mating connectors 126, 614 of the system 900 and Luxury Boat 800.

Additionally, the boat-based controller 608 is configured to establish a connection 910 (in this example a wireless connection of known short range type, but may alternatively be a wired connection) to the controller 112 of the system 900.

Figure 9B:
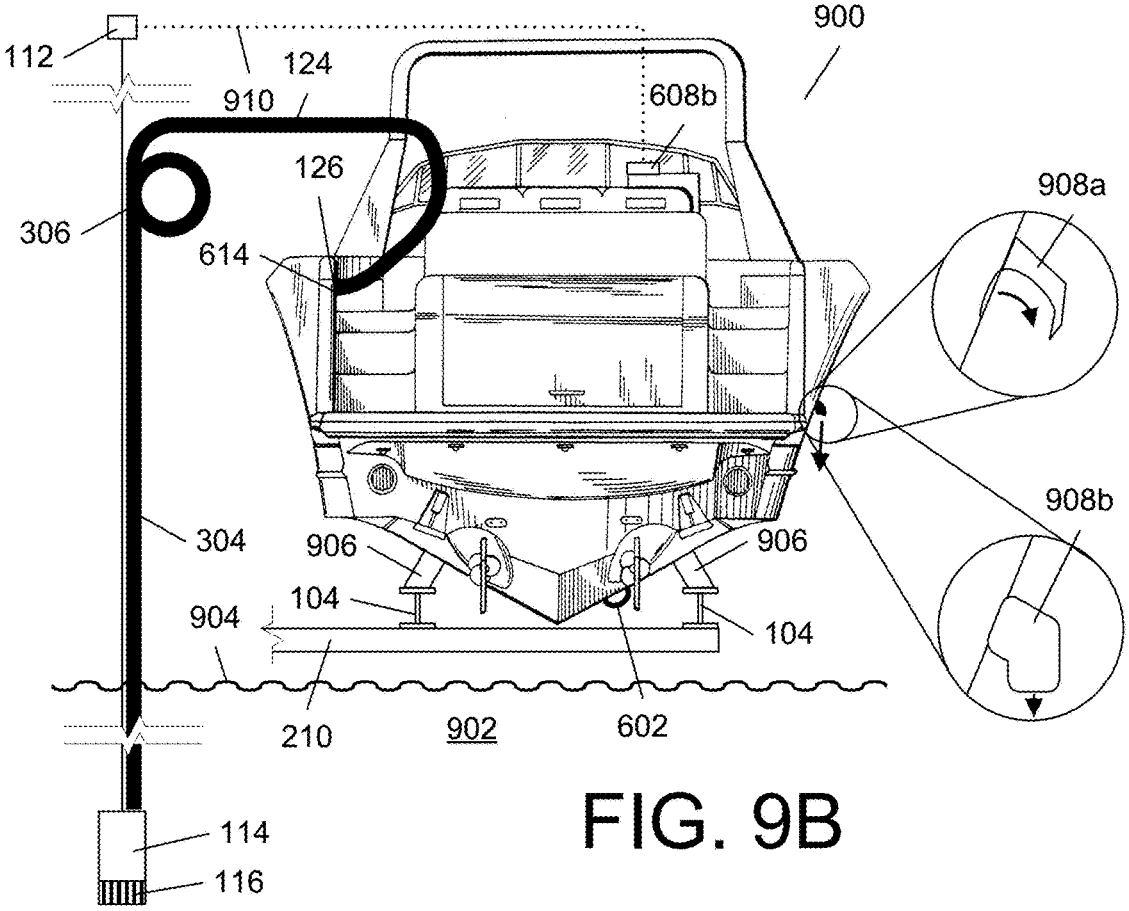
FIG. 9B illustrates, in simplified form, a rear view of the Luxury Boat of FIG. 9A once the Luxury Boat has been raised by the Dry Storage Lift until it is at its raised position above the surface of the raw water source.

FIG. 9B illustrates, in simplified form, a rear view of the Luxury Boat 800 of FIG. 9A once the Luxury Boat 800 has been raised by the Dry Storage Lift until it is at its raised position 106*b* above the surface 904 of the raw water source 902. In conjunction with, or as a result of, the raising of the Dry Storage Lift, the inlet 116 of the pump 114 is lowered into the raw water source 902 to the appropriate depth "D" beneath the surface 904.

Once in this position, in the event that the boat-based controller 608 is to trigger the boat-based pump (not shown) to supply raw water to one or more of the Auxiliary Systems, it will also communicate with, or send a signal to, the controller 112 for the pump 114 so that the pump 114 will provide the water supply to the Luxury Boat 800 via the hose 124 for use in cooling the Auxiliary Systems.

In some cases, when a Luxury Boat is in Temporary Dry Storage and a system constructed according to the teachings herein is in use, raw water exiting the discharge port(s) can undesirably spray people or other nearby boats, or create slippery conditions on the Dry Storage Lift, dock or seawall. To avoid such a situation, optionally, a diverter can be provided in, for example, a form 908*a* that adheres to the hull (permanently, or removably temporarily) or, for example, in a form 908*b* that (permanently, or removably temporarily) inserts into the discharge port(s) to deflect or redirect the discharged raw water downward or in a direction so as to not cause such a condition. It is to be understood in this regard, that the particular form or shape of the diverter, as well as its mode of attachment is one of design choice. Alternatively, in some cases, the hull of the Luxury Boat could be shaped such that it performs the function of the diverter, in which case this problem would be directly avoided.

Figure 10A:
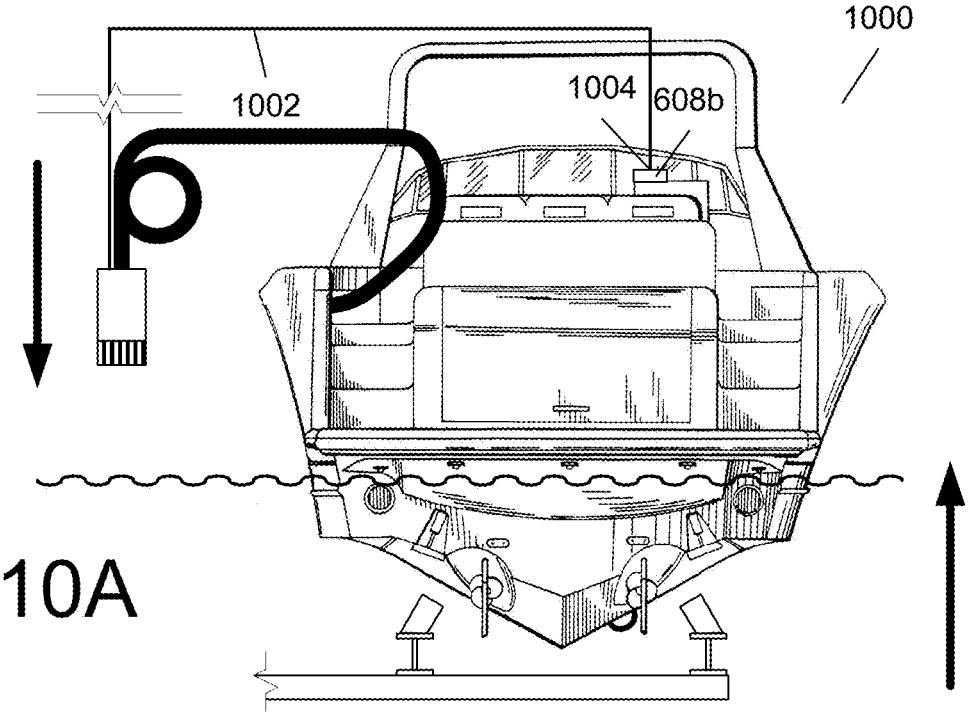
FIGS. 10A-10B illustrate aspects of a further example variant system constructed according to the teachings herein.
Figure 10B:
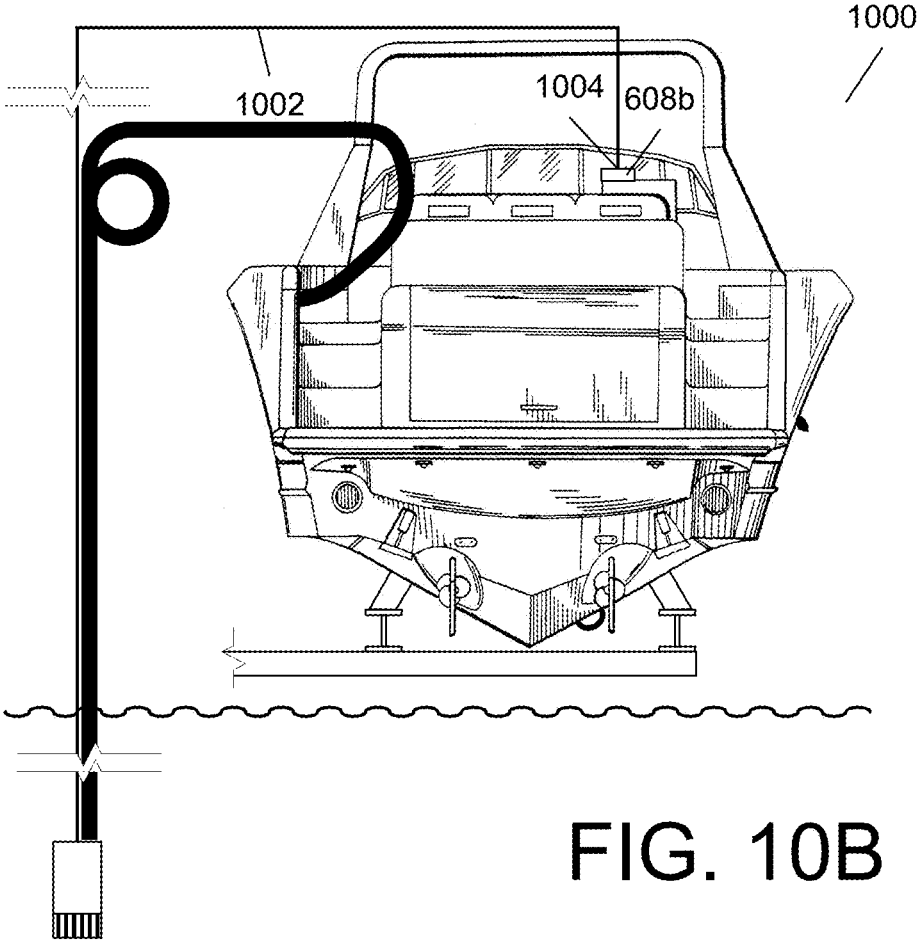

FIGS. 10A-10B illustrate aspects of a further example variant system 1000 constructed according to the teachings herein that is identical to the variant system 900 of FIGS. 9A-9B except that, with this variant, the system lacks the controller 112 of FIGS. 9A-9B. Instead, a wired connection 1002/1004 is established to the boat-based controller such that it will directly control the operation of the pump 114, and optionally, this same (or an associated) wired connection 1002/1004 to the Luxury Boat can be used to provide power to the pump 114 as well from a boat-based power source.

Depending upon the particular variant of the type shown in FIGS. 10A-10B, the raising and lowering of the pump inlet 116 can be controlled by the boat-based controller 608, or it can be accomplished manually (e.g., using a crank) or separately (e.g., using a switch and motor associated with the Dry Storage Lift), for example, by a user on the Dry Storage Lift, dock or seawall.

As will now be recognized, all of the foregoing described variants, and variants that can be created based upon the foregoing teachings avoid use of the scoop strainer when a Luxury Boat is raised on a Dry Storage Lift. However, there are alternative variant configurations that can make use of the scoop strainer of a Luxury Boat when in the raised position.

Figure 11:
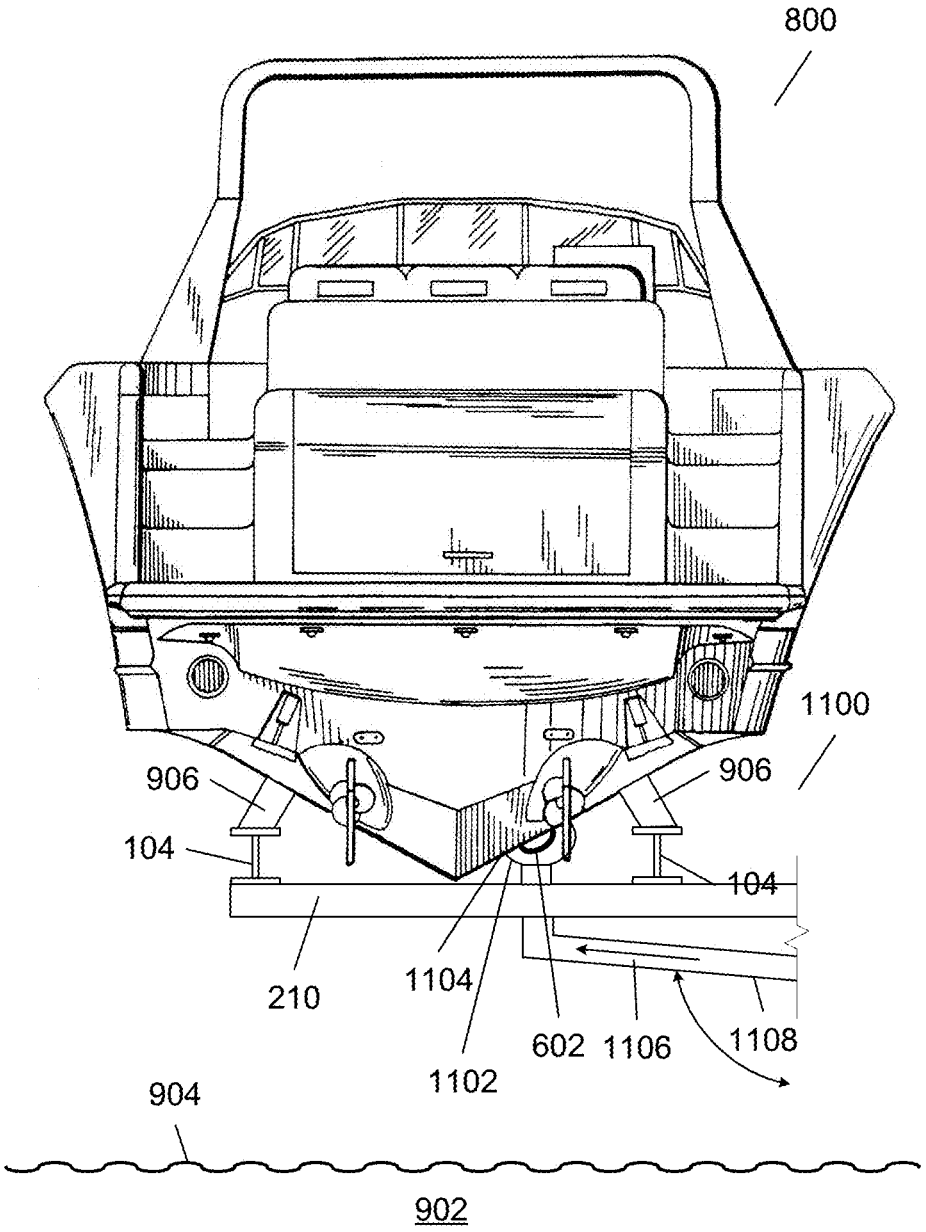
FIG. 11 illustrates, in simplified form, a rear view of the Luxury Boat in conjunction with an example variant system that can make use of the scoop strainer of a Luxury Boat when in the raised position.

FIG. 11 illustrates, in simplified form, a rear view of the Luxury Boat 800 in conjunction with an example variant system 1100 that can make use of the scoop strainer of a Luxury Boat when in the raised position.

As shown in FIG. 11, variants of this type, make use of a bladder 1102 that includes a deformable raw water collar 1104 at its edge that will allow the bladder 1102 to sealingly engage with the hull, peripherally about the scoop strainer 602, such that raw water can be supplied under pressure to the bladder 1102 and into the scoop strainer 602. The bladder 1102 is coupled to a supply hose 1106 through which raw water can be pumped by a pump, as described and shown herein, from a raw water inlet 116 to the bladder 1102. Depending upon the particular configuration, the supply hose 1106 can be part of a rigid arm 1108 that is movable such that the bladder 1102 is engaged with, or disengaged from, the hull of the Luxury Boat 800, the supply hose 1106 can be a separate hose associated with the rigid arm 1108. Moreover, depending upon the particular configuration, the bladder 1102 and rigid arm 1108 can be constructed such that, with some configurations, pivoting movement of the rigid arm 1108 causes raw water collar 1104 to engage/disengage with the hull, whereas with other configurations, sliding movement of an arm can be used to causes the raw water collar 1104 to engage/disengage with the hull, whereas, with still other configurations, an arm can be used to slide or pivot the bladder 1102 into a position directly below the scoop strainer of the Luxury Boat and then some nominal amount of lowering of the Dry Storage Lift will cause the raw water collar 1104 to engage the hull for purposes of supplying raw water to the Luxury Boat via the scoop strainer 602.

Thus, in overview, one such alternative configuration system of this type would involve a Dry Storage Lift and a pump coupled to the Dry Storage Lift. The pump has a raw water inlet and raw water outlet.

A raw water collar is coupled to the raw water outlet and has a peripheral edge configured to be able to form a seal against a hull of a Luxury Boat about a scoop strainer of the Luxury Boat that is used as an inlet for raw water to cool an Auxiliary System of the Luxury Boat when the Luxury Boat is not on the Dry Storage Lift and a portion of the hull containing the scoop strainer is submerged within a body of water. The pump will be controlled such that, when the Luxury Boat is on the Dry Storage Lift and the raw water collar engages the hull and forms the seal against the hull, the pump can provide raw water, via the raw water collar, to the scoop strainer of the Luxury Boat.

Another alternative configuration system would involve a Dry Storage Lift capable of moving a Luxury Boat, between an in-water position and a dry storage position, the Luxury Boat having a hull and a scoop strainer located on the hull. A bladder is associated with the Dry Storage Lift and moveable between a first position and a second position, wherein, in the first position, the bladder is sealingly engaged with the hull such that a periphery of an edge of the bladder surrounds the scoop strainer, and in the second position, the bladder is disengaged from the hull.

The system would further include a pump having an associated raw water inlet and a raw water outlet, with the raw water outlet coupled to the bladder. The raw water inlet is movable between a first location, within a raw water source, and a second location, out of the raw water source. Movement of the bladder and raw water inlet are controlled such that when the Luxury Boat is in the dry storage position, the bladder will be in the first position and the raw water inlet will be in the first location, and when the Luxury Boat is in the in-water position, the bladder will be in the second position and the raw water inlet will be in the second location.

Thus, it should no be appreciated that numerous further variants can be constructed by applying the teachings herein.

Having described, in overview, the construction and operation of raw water supply control for a Luxury Boat in Temporary Dry Storage that can be constructed by those of ordinary skill in the art, some specific examples of commercially suitable implementation s will now be discussed.

Figure 12:
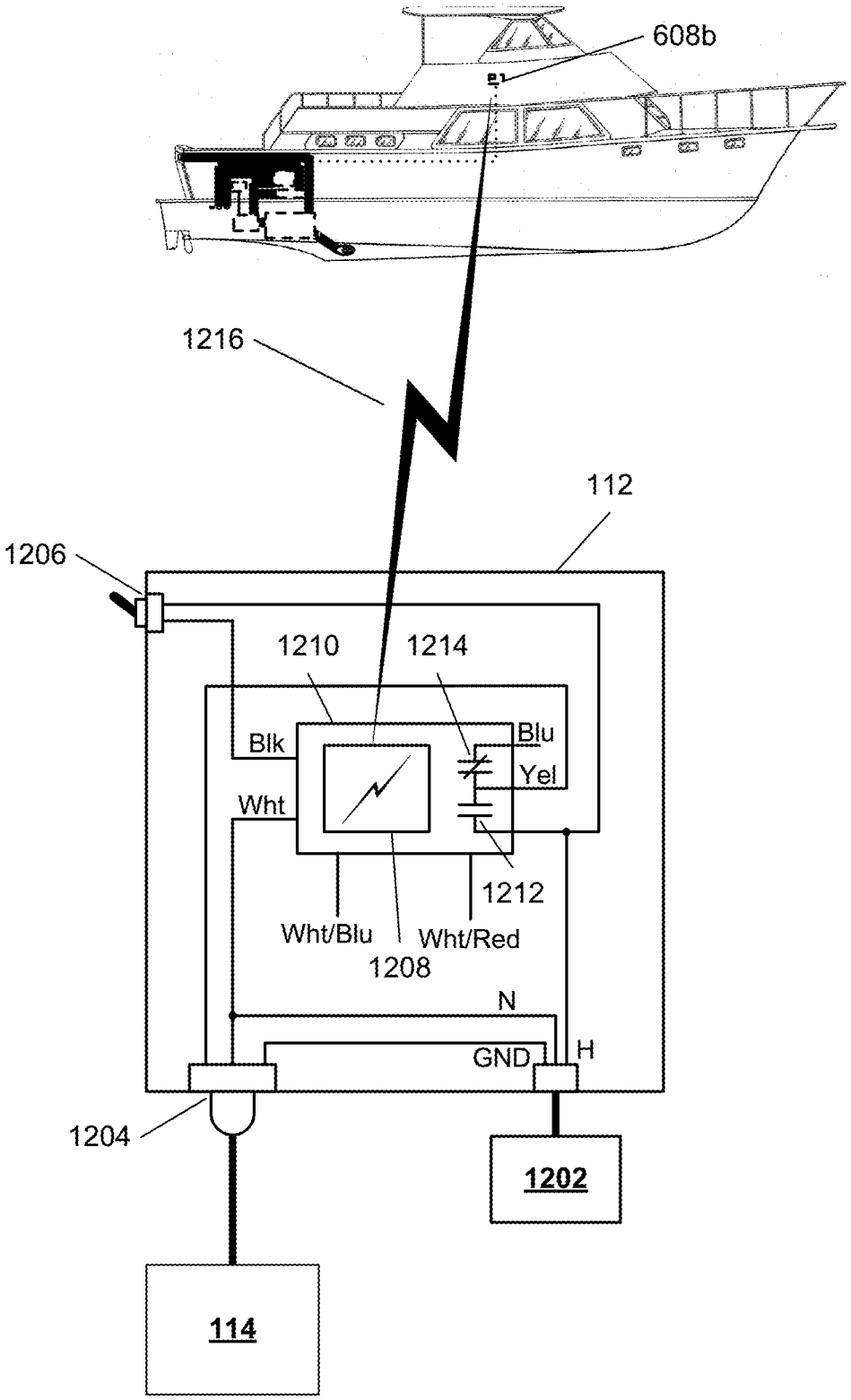
FIG. 12 illustrates, in simplified form, further representative example details, in context, of a controller 112 as described herein.

FIG. 12 illustrates, in simplified form, further representative example details, in context, of a controller 112 as described herein. As shown, the controller 112 is coupled to a power source 1202 and includes a connection 1204 or outlet via which the pump 114 can receive power in a controlled fashion. The controller 112 further includes a switch 1206 that is used to turn the controller 112 on and off. As shown, for simplicity, the switch 1206 is illustrated as a manual switch, however, in alternative configurations, the controller can be configured 112 so that it can turn be turned on and off remotely or automatically, using known techniques, since the method by which the controller is turned on and off is a matter of design choice that is unimportant to understanding the subject matter described herein.

As further shown in FIG. 12, the controller 112 includes a transceiver or receiver 1208 via which it can receive signals from a boat-based controller 608*b*, wirelessly or via a wired connection, depending upon the particular implementation. Moreover, depending upon the particular implementation, the transceiver can communicate using, for example, an appropriate radio frequency, for example, in the 900 MHz band, or using WiFi, Bluetooth, or, in appropriate situations an appropriate frequency electrical or optical signal. The transceiver or receiver 1208 is part of a module 1210 that further includes relays 1212, 1214 whose state can be set or modified based upon a signal received by transceiver or receiver 1208.

One example of a commercially available device suitable for use as the module 1210 is the RIBW01B-EN3 Wireless Control Relay commercially available from Functional Devices, Inc., 101 Commerce Drive, Sharpsville, IN 46068. Purely for completeness of understanding, the module 1210 is shown in FIG. 12 as being wired as if the RIBW01B-EN3 Wireless Control Relay was used and configured purely as a receiver.

In operation, when the receiver 1208 receives an appropriate signal 1216 from a boat-based controller, the module 1210 will change the state of the relay 1212 such that power is supplied to, or removed, from the pump 114.

Figure 13A:
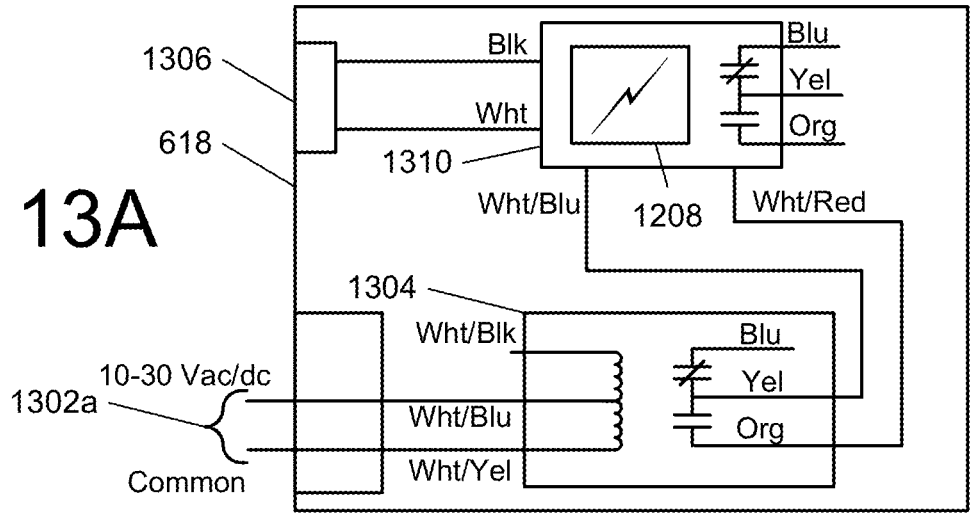
FIGS. 13A-13C illustrate, in simplified form, representative example details, in context, of a sensor for use in systems as described herein.
Figure 13B:
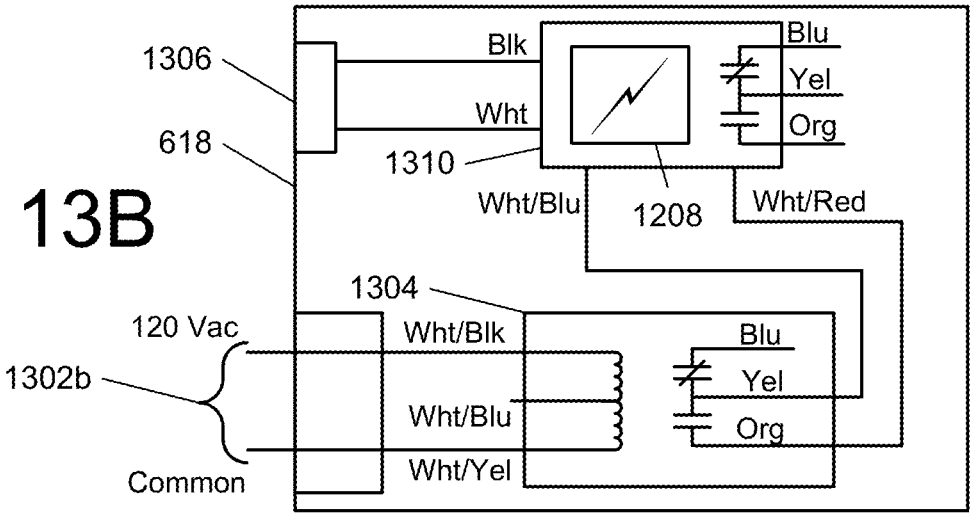
Figure 13C:
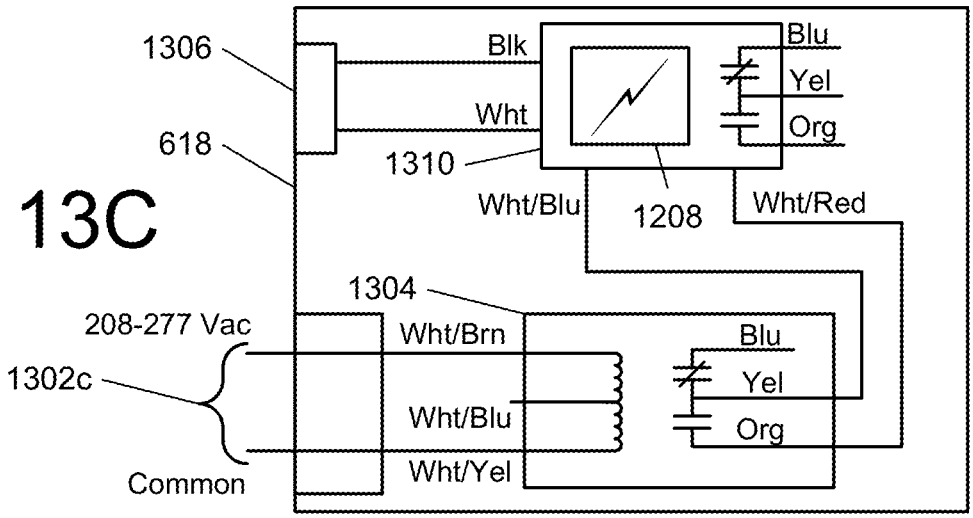

FIGS. 13A-13C illustrate, in simplified form, representative example details, in context, of a sensor 618 of a Luxury Boat, for use as described herein when the Luxury Boat is in Temporary Dry Storage. More particularly, the sensor 618 of FIG. 13A is configured for use with an Auxiliary System that operates at 12/24 volts (AC or DC), the sensor 618 of FIG. 13B is configured for use with an Auxiliary System that operates at 120 volts AC, and the sensor 618 of FIG. 13C is configured for use with an Auxiliary System that operates at 208 to 277 volts AC.

As shown in each of FIGS. 13A-13C, the sensor 618 is configured to receive an input 1302*a*, 1302*b*, 1302*c* sensed from the boat-based controller trigger signal indicating either that an Auxiliary System is operating and needs raw water for cooling or, if already operating, the Auxiliary System is shut off so raw water is no linger needed. That signal is received by a relay module 1304, for example, for compatibility with the module 1210, the RIBU1C or RIBH1C Pilot Control Relay, each also commercially available from Functional Devices, Inc., 101 Commerce Drive, Sharpsville, IN 46068. The relay module 1304 is coupled to receive the trigger signal and change the state of one or more internal relay(s) based upon the trigger signal.

As would be expected, the sensor 618 is powered from a power source (not shown) via a power input 1306.

As shown in FIG. 13A, the relay module 1304 is wired for Auxiliary Systems that operate at 12/24 volts, as shown in FIG. 13B, the relay module 1304 is wired for Auxiliary Systems that operate at 120 volts AC, and, as shown in FIG. 13C, the relay module 1304 is wired for Auxiliary Systems that operate at 208 to 277 volts AC.

The relay module 1304 is connected to a module 1310 that is, for example, the same as the module 1210 of FIG. 12 except that the module 1310 is configured as a transceiver or transmitter.

As such, when an Auxiliary System trigger signal 1302*a*, 1302*b*, 1302*c* is sent by the boat-based pump controller indicating that raw water is required, or no longer required, sensor 618 will sense that as an input to the relay module 1304, which will, in turn, change state and, supply a signal to the module 1310 that will, in turn, cause the module 1310 to send a signal 1216 back to the receiver 1208 so that the controller 112 will either turn the pump on or off based upon the signal sent. In this manner, raw water can be supplied to the Auxiliary System even though the Luxury Boat is in Temporary Dry Storage.

As will now be appreciated, the sensors 618 of FIGS. 13A-13C are each configured for use with a single Auxiliary System. However, in some cases, a given Luxury Boat may have more than one Auxiliary System, with each operating independently of any others. Advantageously, a sensor 618 can readily be constructed and configured to work with such separate systems.

Figure 14:
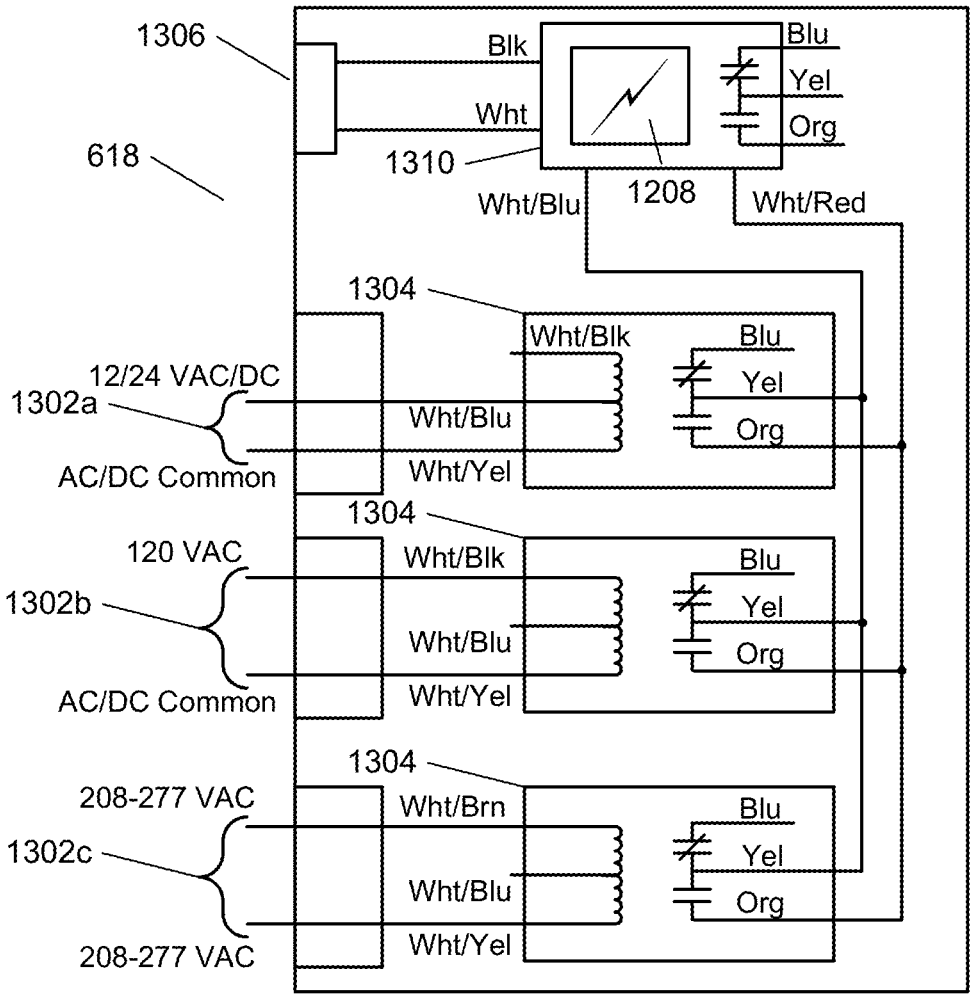
FIG. 14 illustrates, in simplified form, an example alternative sensor that is constructed and configured to work with three discrete, and independent, Auxiliary Systems.

FIG. 14 illustrates, in simplified form, an example alternative sensor 618 that is constructed and configured to work with three discrete, and independent, Auxiliary Systems, one that is controlled by a trigger signal of between 10 and 30 volts ac/dc, one that is controlled by a trigger signal at 120 volts, and one that is controlled by a trigger signal of between 208 and 277 volts ac. As shown, it should be appreciated that the sensor 618 of FIG. 14 otherwise operates similar to the sensors of FIGS. 13A-13C, but in a collective fashion. Thus, for the sensor 618 of FIG. 14, when the Luxury Boat is in Temporary Dry Storage (and the controller 112 is switched on), if any of the Auxiliary Systems requires raw water, the sensor 618 will sense the boat-based controller's signal and cause a signal to be sent by the module 1310 to the controller 112 that will cause the pump 114 to turn on. As configured, as long as at least one Auxiliary Systems continues to need raw water, the sensor will not cause the controller 112 to shut off the pump 114. Only if all of the Auxiliary Systems no longer require raw water will the sensor 618 cause a signal to be sent to the controller 112 to shut off the external pump 114.

Figure 15:
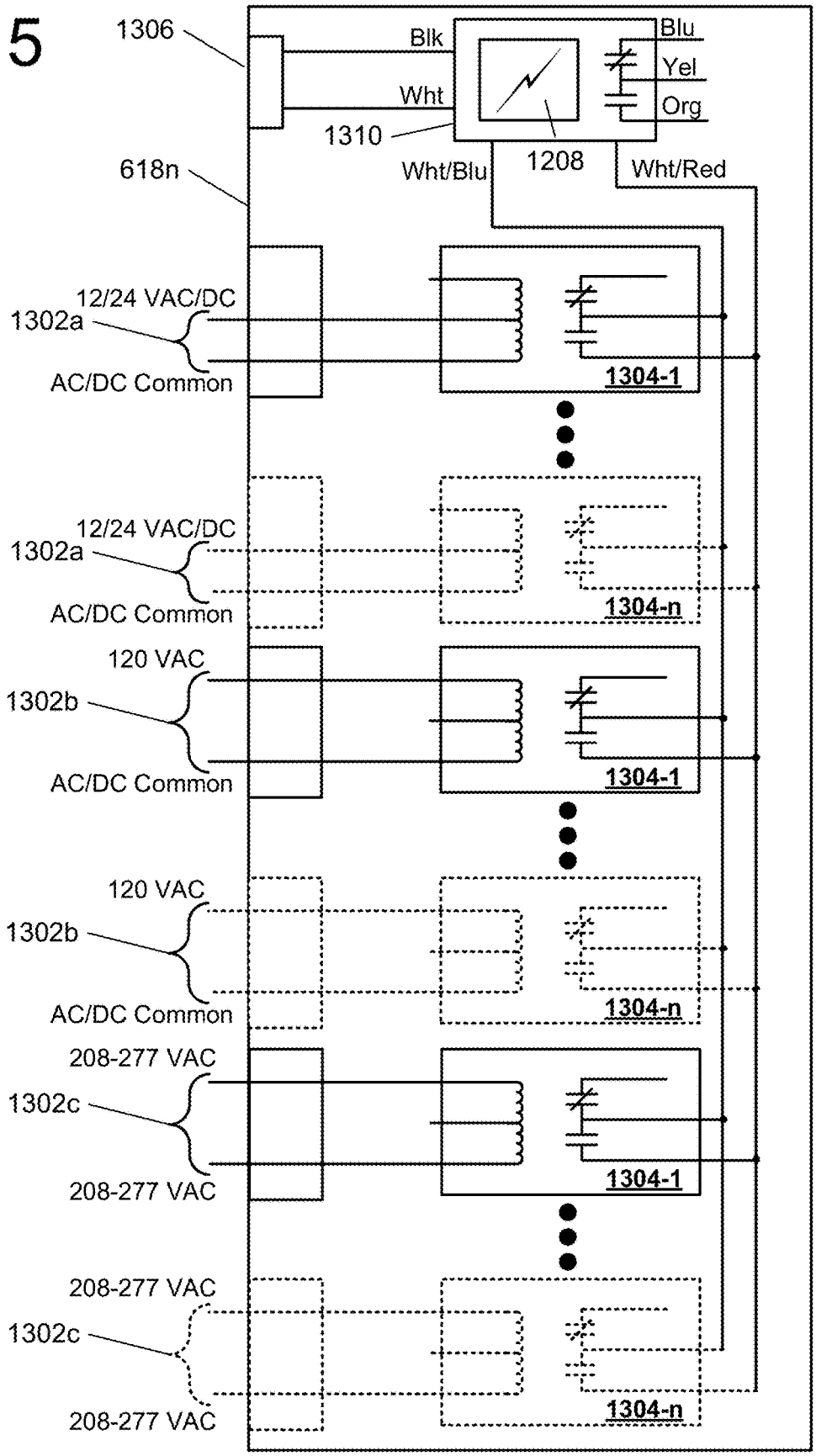
FIG. 15 illustrates, in simplified form, an example of another alternative sensor that is similar to the sensor of FIG. 14 except that it is constructed and configured to work with multiple Auxiliary Systems.

FIG. 15 illustrates, in simplified form, an example of another alternative sensor 618*n* that is similar to the sensor of FIG. 14 except that it is constructed and configured to work with multiple Auxiliary Systems. As shown, the example sensor 618 of FIG. 15 can operate in a Luxury Boat having between 1 and "n" Auxiliary Systems controlled by a trigger signal of between 10 and 30 volts ac/dc, and/or having between 1 and "n" Auxiliary Systems controlled by a trigger signal at 120 volts, and/or between 1 and "n" Auxiliary Systems controlled by a trigger signal of between 208 and 277 volts ac. Thus, the sensor 618*n* represents numerous configurations of sensors that can be created to specifically match the number and type of Auxiliary Systems of a particular Luxury Boat.

Of course, it should now be understood that other configurations can be created by ganging one or more of the sensors 618 of FIGS. 13A-13C, one or more of those sensors in conjunction with the sensor 618 of FIG. 14, or by ganging two or more of the sensors 618 of FIG. 14 to achieve similar results.

In short, where there are multiple Auxiliary Systems, the sensing in the system operates like a logic "OR" function such that, when he Luxury Boat is in Temporary Dry Storage and the controller 112 is on, if the boat-based controller signals that any of the Auxiliary Systems need raw water for cooling, the controller will cause the external pump to pump raw water to the Luxury Boat. If all of the Auxiliary Systems no longer need raw water for cooling, then the signal from the boat-based controller to the boat based pump to shut off will be sensed and a signal will be sent to the controller 112 to turn off the external pump 114.

As noted above, a separate problem affects Luxury Boats located in areas where the temperature can drop to a temperature below freezing for enough time that raw water in the various raw water lines between the scoop strainer and the discharge port(s) can freeze. In such locations, those raw water lines need to be winterized by either clearing them of all raw water, which is a very difficult task, or by displacing any raw water in those raw water lines and filling the raw water lines with an appropriate antifreeze mixture for the location, which is also difficult and time consuming, particularly when there are multiple Auxiliary Systems located at various parts of the Luxury Boat.

Advantageously, systems as described herein can easily be used to more efficiently accomplish the task. To do so, one would merely create a reservoir of an appropriate volume of antifreeze mixture. Then one would simply connect the system up with the Luxury Boat on the Dry Storage Lift as if raw water was to be pumped and then cycle through running of each of the Auxiliary Systems until antifreeze exits the appropriate discharge port(s), at which point the associated discharge ports can be plugged and the Luxury Boat wrapped and/or stored. When the season changes or the temperatures are reliably above concern and the the Luxury Boat is to be used again, the antifreeze can easily be flushed in the same manner by having the raw water inlet place in the raw water source again.

The foregoing outlines, generally, the features and technical advantages of one or more implementations that can be constructed based upon the teachings in this disclosure in order that the following detailed description may be better understood. However, the advantages and features described herein are only a few of the many advantages and features available from representative examples of possible variant implementations and are presented only to assist in understanding. It should be understood that they are not to be considered limitations on the invention as defined by the appended claims, or limitations on equivalents to the claims. For instance, some of the advantages or aspects of different variants are mutually contradictory, in that they cannot be simultaneously present in a single embodiment. Similarly, some features or advantages may be applicable to one aspect and inapplicable to others. Thus, the foregoing features and advantages should not be considered dispositive in determining equivalence. Additional features and advantages will be apparent from the teachings of the description, drawings, and claims.

What is claimed is:

1. A system for providing raw water for cooling of one or more Auxiliary Systems of a Luxury Boat, when the Luxury Boat is in Temporary Dry Storage, the system comprising:

a pump, external to a Luxury Boat in Temporary Dry Storage, the pump having an associated raw water inlet and a raw water outlet;

a hose having a first end being coupled to the raw water outlet and a second end configured to matingly couple to a connector on the Luxury Boat that is coupled to at least one Auxiliary System of the Luxury Boat;

a controller coupled to the pump external to the Luxury Boat;

a sensor coupled to a boat-based pump controller on the Luxury Boat, wherein the boat-based pump controller controls pumping of raw water to the at least one Auxiliary System on the Luxury Boat;

wherein the sensor is configured to sense a trigger signal from the boat-based pump controller indicating that raw water is to be pumped to the at least one Auxiliary System and send a signal to the controller that will cause the controller to start the pump external to the Luxury Boat pumping raw water to the at least one Auxiliary System on the Luxury Boat in Temporary Dry Storage via the hose.

2. The system of claim 1, wherein the external pump is mounted on one of:

a piling associated with the Dry Storage Lift, a dock to which the Dry Storage Lift is coupled, a seawall to which the Dry Storage Lift is coupled, or a support frame of the Dry Storage Lift.

3. The system of claim 1, wherein the external pump is a self-priming pump, and wherein the hose is a first hose, and wherein the system comprises a second hose having one end coupled to a raw water inlet side and having an other end that is the raw water inlet.

4. The system of claim 1, wherein the external pump is a submersible pump and the raw water inlet is part of the pump.

5. The system of claim 1, wherein the external pump is coupled to the at least one Auxiliary System, via a sea chest on the Luxury Boat coupled to the connector.

6. The system of claim 1, wherein the external pump is coupled to the at least one Auxiliary System, via a manifold on the Luxury Boat coupled to the connector.

7. The system of claim 1, wherein, when the boat-based pump controller sends a signal that raw water is to stop being pumped to the at least one Auxiliary System, the sensor will sense that signal and signal the controller to cause the external pump to stop pumping raw water to the Luxury Boat.

8. A system for use with a Dry Storage Lift capable of moving Luxury Boats between an in-water position and a dry storage position, the system comprising:

a pump having an associated raw water inlet and a raw water outlet;

wherein the raw water outlet is configured to matingly couple, via a connector, to a corresponding connector on a through-hull fitting of a Luxury Boat;

a sensor associated with a boat-based pump controller; and a controller, communicatively coupled to the sensor, such that when the boat-based pump controller of a Luxury Boat on a Dry Storage Lift sends a signal for raw water to be sent to at least one Auxiliary System of the Luxury Boat when the Luxury Boat is in Temporary Dry Storage, the sensor will sense the signal and send a pump signal to the controller so that the controller will cause the pump to deliver raw water to the Luxury Boat, for use by the at least one Auxiliary System, via the raw water outlet.

9. The system of claim 8, wherein the pump is a submersible pump coupled to the Dry Storage Lift such that (A) when the Dry Storage Lift is in the in-water position, the external pump will be entirely above a surface of a raw water source, and (B) when the Dry Storage Lift is in the dry storage position, the external pump will be submerged below the surface of the raw water source.

10. The system of claim 8, wherein the controller and the boat-based pump controller are communicatively coupled by a wired connection.

11. The system of claim 8, wherein the controller and the boat-based pump controller are communicatively coupled by a wireless connection.

12. The system of claim 8, wherein the signal is a trigger signal in the range of 10 to 30 volts.

13. The system of claim 8, wherein the signal is a trigger signal is a 120 volt ac signal.

14. The system of claim 8, wherein the signal is a trigger signal in the range of 208 to 277 volts ac.

15. A method for controlling raw water supply to one or more Auxiliary Systems of a Luxury Boat, when the Luxury Boat is in Temporary Dry Storage, the method comprising:

sensing a trigger signal sent by a boat-based pump controller indicating that raw water is to either be supplied to the one or more Auxiliary Systems of the Luxury Boat in Temporary Dry Storage or stop being supplied to the one or more Auxiliary Systems of the Luxury Boat in Temporary Dry Storage;

based upon the sensing, sending a signal to a controller of a pump that is both external to, and coupled to, the Luxury Boat such that (A) if the sensed trigger signal indicates that raw water is to be supplied to the one or more Auxiliary Systems of the Luxury Boat, the signal will cause the controller to turn on an external pump coupled to the controller, and (B) if the sensed trigger signal indicates that raw water is to stop being supplied to the one or more Auxiliary Systems of the Luxury Boat, the signal will cause the controller to turn off the external pump.

16. The method of claim 15, wherein the signal is one of:

a 900 Mhz band frequency;

a WiFi signal;

a Bluetooth signal; or an optical signal.

17. The method of claim 15 wherein the sensing of the trigger signal causes a state of a relay in the sensor to change.

18. The method of claim 15 wherein the sensing of the trigger signal causes a transmitter to transmit a signal to a controller that is external to the Luxury Boat.

* * * * *